US009417541B2

(12) United States Patent
Ishikawa et al.

(10) Patent No.: US 9,417,541 B2
(45) Date of Patent: Aug. 16, 2016

(54) TONER AND IMAGE FORMING APPARATUS

(75) Inventors: Yoshimichi Ishikawa, Hyogo (JP); Takuya Kadota, Hyogo (JP); Yoshihiro Mikuriya, Hyogo (JP); Tsuyoshi Nozaki, Osaka (JP); Kazuoki Fuwa, Hyogo (JP); Tomohiro Fukao, Osaka (JP); Tomoharu Miki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/112,407

(22) PCT Filed: Apr. 25, 2012

(86) PCT No.: PCT/JP2012/061623

§ 371 (c)(1),
(2), (4) Date: Oct. 17, 2013

(87) PCT Pub. No.: WO2012/147988

PCT Pub. Date: Nov. 1, 2012

(65) Prior Publication Data

US 2014/0038095 A1 Feb. 6, 2014

(30) Foreign Application Priority Data

Apr. 26, 2011 (JP) ..... 2011-097867

(51) Int. Cl.
*G03G 9/097* (2006.01)
*G03G 9/08* (2006.01)
(Continued)

(52) U.S. Cl.
CPC ..... *G03G 9/0825* (2013.01); *G03G 9/0804* (2013.01); *G03G 9/0806* (2013.01); *G03G 9/0819* (2013.01); *G03G 9/0827* (2013.01); *G03G 9/08708* (2013.01); *G03G 9/09307* (2013.01); *G03G 9/09321* (2013.01); *G03G 9/09392* (2013.01); *G03G 9/09716* (2013.01)

(58) Field of Classification Search
USPC ..... 430/108.6, 108.7, 110.1, 110.3; 399/222
See application file for complete search history.

(56) References Cited

U.S. PATENT DOCUMENTS 4,950,573 A 8/1990 Yamaguchi et al.
5,710,965 A 1/1998 Nozawa et al.
(Continued)

FOREIGN PATENT DOCUMENTS

CN 101097413 A 1/2008
JP 07-114211 5/1995
(Continued)

OTHER PUBLICATIONS

International Search Report Issued for counterpart International Patent Application No. PCT/JP2012/061623 dated Jun. 5, 2012.
(Continued)

*Primary Examiner* — Peter Vajda
(74) *Attorney, Agent, or Firm* — Oblon, McClelland, Maier & Neustadt, L.L.P.

(57) ABSTRACT

A toner including: toner particles each including a toner base particle and an external additive attached thereon, where the toner base particle includes a binder resin and a colorant, wherein the toner base particles each have protrusions on a surface thereof, an average of lengths of long sides of the protrusions is 0.10 μm or more but less than 0.50 μm, a standard deviation of the lengths of the long sides of the protrusions is 0.2 or less, a coverage rate of the protrusions on the surface of the toner base particle is 10% to 90%, and the external additive includes fine inorganic particles whose surfaces have been treated with an amino group-containing silane coupling agent.

20 Claims, 5 Drawing Sheets

(51) Int. Cl.
*G03G 9/087* (2006.01)
*G03G 9/093* (2006.01)

(56) References Cited

U.S. PATENT DOCUMENTS

| | | | | |
|---|---|---|---|---|
| 5,770,342 | A | 6/1998 | Okae et al. | |
| 2003/0190540 | A1* | 10/2003 | Shoshi et al. | 430/78 |
| 2005/0164114 | A1 | 7/2005 | Yagi et al. | |
| 2005/0196694 | A1 | 9/2005 | Yuasa et al. | |
| 2007/0141500 | A1 | 6/2007 | Sugimoto et al. | |
| 2008/0124635 | A1 | 5/2008 | Nakamura et al. | |
| 2008/0206665 | A1 | 8/2008 | Yuasa et al. | |
| 2008/0233496 | A1* | 9/2008 | Kotsugai et al. | 430/48 |
| 2009/0233211 | A1* | 9/2009 | Takahashi | G03G 9/0823 430/109.4 |
| 2010/0055603 | A1 | 3/2010 | Nozaki et al. | |
| 2011/0053063 | A1 | 3/2011 | Kadota et al. | |
| 2011/0053071 | A1 | 3/2011 | Miki et al. | |
| 2011/0250533 | A1 | 10/2011 | Kadota et al. | |
| 2011/0287356 | A1 | 11/2011 | Fukao et al. | |
| 2012/0219321 | A1 | 8/2012 | Fukao et al. | |
| 2012/0237267 | A1 | 9/2012 | Fukao et al. | |
| 2012/0264048 | A1 | 10/2012 | Ishikawa et al. | |
| 2013/0029260 | A1 | 1/2013 | Nozaki et al. | |

FOREIGN PATENT DOCUMENTS

| | | | | |
|---|---|---|---|---|
| JP | 09-258480 | | 10/1997 | |
| JP | 2750853 | B2 | 5/1998 | |
| JP | 2838410 | B2 | 12/1998 | |
| JP | 2876898 | B2 | 3/1999 | |
| JP | 3155849 | B2 | 4/2001 | |
| JP | 2002-174926 | | 6/2002 | |
| JP | 2003-202701 | | 7/2003 | |
| JP | 2004-086131 | | 3/2004 | |
| JP | 2005-284269 | | 10/2005 | |
| JP | 2006-071994 | | 3/2006 | |
| JP | 2006-184746 | | 7/2006 | |
| JP | 2006-251267 | | 9/2006 | |
| JP | 2008-090256 | | 4/2008 | |
| JP | 2008-170901 | | 7/2008 | |
| JP | 2008-233430 | A | 10/2008 | |
| JP | 2008-268872 | | 11/2008 | |
| JP | 4181960 | B2 | 11/2008 | |
| RU | 2 125 968 | C1 | 2/1999 | |
| WO | WO 2011/052794 | * | 5/2011 | G03G 9/08 |
| WO | WO 2011/052794 | A1 | 5/2011 | |

OTHER PUBLICATIONS

U.S. Appl. No. 14/113,487, filed Oct. 23, 2013, Fukao, et al.

Extended European Search Report issued Sep. 11, 2014 in Patent Application No. 12777245.7.

International Search Report Issued Jun. 5, 2012 in PCT/JP2012/061629 Filed Apr. 25, 2012.

Extended European Search Report issued Sep. 11, 2014 in Patent Application No. 12776825.7.

Chinese Office Action dated Jan. 26, 2016 issued in corresponding Chinese patent application No. 201280031557.0 (with English translation).

Chinese Office Action dated Jan. 25, 2016 issued in corresponding Chinese patent application No. 201280031557.0 (with English translation).

* cited by examiner

TONER AND IMAGE FORMING APPARATUS

TECHNICAL FIELD

The present invention relates to a toner for developing a latent electrostatic image formed in an electrophotographic method, an electrostatic recording method and an electrostatic printing method, and to an image forming apparatus.

BACKGROUND ART

Dry-process developing devices using a powdery developing agent have widely been employed in image forming apparatuses such as electronic copiers, printers and facsimiles, in which a latent electrostatic image formed on a latent image bearing member is visualized with a developer to obtain a recorded image.

In recent years, color image forming apparatuses using electrophotographic process have broadly been employed, and digitized images are easily available. Thus, it is required to make an image to be printed at higher definition. While studying higher resolution and gradation of an image, as an improvement of a toner which visualizes a latent image, it has been studied to further conglobate and minimize in particle size for forming the image at high definition. And, since in the toners produced by the pulverizing methods, their conglobation and minimization are limited, so-called polymerized toners produced by a suspension polymerization method, an emulsification polymerization method and a dispersion polymerization method capable of conglobtaining and minimizing in particle size have been being employed.

The polymerized toner has a small particle diameter and thus has high adhesion force to members, leading to degradation in transfer efficiency and occurrence of filming. The polymerized toner also has a spherical shape and thus has poor cleanability. In addition, in the process of producing the polymerized toner, toner components having lower resistance are localized in the vicinity of the surfaces of the toner base particles, so that the chargeability becomes lower to cause background smear.

Furthermore, since there is a high need for a toner having low-temperature fixing property to achieve energy saving, it is desired to use a binder resin having a low melting temperature. However, the toner having low-temperature fixing property has a newly arising problem relating to heat resistance storageability.

In view of this, attempts to solve these problems by modifying surfaces of toner base particles have been made. The method for surface modification disclosed is, for example, a method in which surfaces of toner base particles each containing a first resin particle and a colorant are partially or entirely coated with second resin particles (see, for example, PTL 1). However, in this disclosed method, the second resin particles are too varied and ununiform. The obtained toner particles increase in cleaning property but not sufficiently improve in background smear nor storageability. In addition, they also cause degradation in transferability.

CITATION LIST

Patent Literature

PTL 1: Japanese Patent Application Laid-Open (JP-A) No. 2008-090256

SUMMARY OF INVENTION

Technical Problem

An object of the present invention is to provide: a toner which does not contaminate a charging unit, a developing unit, a photoconductor and an intermediate transfer member, which can form a high-quality image having a proper image density with much less background smear even after long-term repetitive printing, and which can stably form an image with high reproducibility on any recording medium without involving blur or spot due to scattering: and an image forming apparatus using the toner.

Solution to Problem

Means for solving the above problems are as follows. Specifically, a toner of the present invention is a toner including:

toner particles each including a toner base particle and an external additive attached thereon, where the toner base particle includes a binder resin and a colorant, wherein the toner base particle has protrusions on a surface thereof, wherein an average of lengths of long sides of the protrusions is 0.10 μm or more but less than 0.50 μm, wherein a standard deviation of the lengths of the long sides of the protrusions is 0.2 or less, wherein a coverage rate of the protrusions on the surface of the toner base particle is 10% to 90%, and wherein the external additive includes fine inorganic particles whose surfaces have been treated with an amino group-containing silane coupling agent.

Advantageous Effects of Invention

The present invention can provide a toner which does not contaminate a charging unit, a developing unit, a photoconductor and an intermediate transfer member, which can form a high-quality image having a proper image density with much less background smear even after long-term repetitive printing, and which can stably form an image with high reproducibility on any recording medium without involving blur or spot due to scattering; and an image forming apparatus using the toner. These toner and image forming apparatus are considerably useful in the field of electrophotographic development.

DESCRIPTION OF EMBODIMENTS (Toner)

Figure 1:
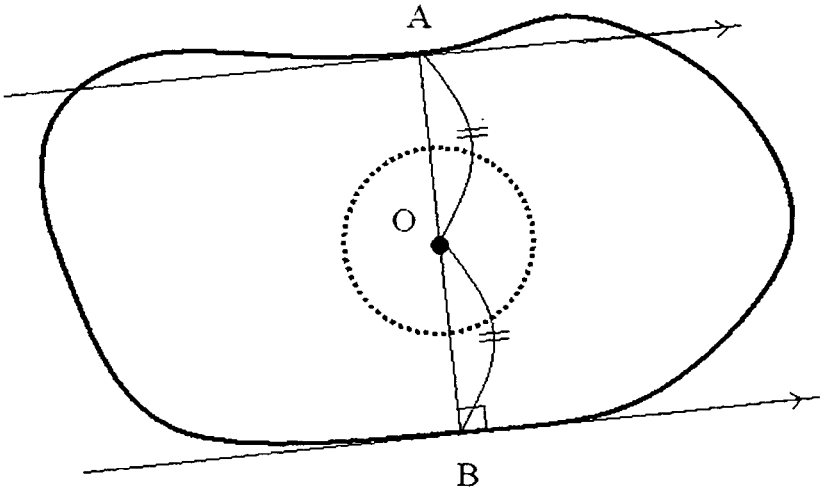
FIG. 1 is a sketch used for explaining one measuring method of a protrusion of a toner of the present invention.

A toner of the present invention includes toner base particles and protrusions on each of the surfaces of the toner base particles, wherein an average of lengths of long sides of the protrusions is 0.10 μm or more but less than 0.50 μm, a standard deviation of the lengths of the long sides of the protrusions is 0.2 or less, a coverage rate of the protrusions on the surface of the toner base particle is 10% to 90%. Provision of such protrusions on the surfaces of the toner base particles can achieve high-quality image formation. One possible reason why this advantageous effect can be obtained lies in the following.

In the process of producing polymerized toners, toner components having lower resistance are localized in the vicinity of the surfaces of toner base particles. Thus, provision of protrusions free of low-resistance toner components on the surfaces of the toner base particles suppresses the occurrence of background smear due to low chargeability. Also, by virtue of concave and convex portions on their surface, it is possible to reduce the contact area with members while their sphericity is being kept high. Thus, adhesion resistance, transferability and cleanability are expected to improve. In addition, the surface modification made without entirely covering the toner base particles can improve storageability of the resultant toner under high-temperature, high-humidity conditions while retaining low-temperature fixing property.

<Long Side and Surface Coverage Rate of Protrusion>

In order to achieve the above, the protrusions are required to meet the following conditions. The term "long side of the protrusion" as used herein means the longest line segment among line segments connecting any two points on the boundary between a protrusion and a toner core particle (in FIG. 7, the term "long side of the protrusion" refers to the line segment ranging between the two points shown by two arrows).

The average of the lengths of the long sides of the protrusions is not particularly limited, so long as it is 0.10 μm or more but less than 0.50 μm, and may be appropriately selected depending on the intended purpose. It is preferably 0.10 μm to 0.3 μm. When the average of the lengths is less than 0.10 μm, the effects brought by the protrusions cannot be obtained in some cases. When the average of the lengths is more than 0.5 μm, the shapes of the protrusions and toners become ununiform, resulting in that there may be failures such as background smear and a drop in transfer rate.

The standard deviation of the lengths of the long sides of the protrusions is not particularly limited, so long as it is 0.2 or less, and may be appropriately selected depending on the intended purpose. It is preferably 0.1 or less. When the standard deviation thereof is higher than 0.2, the sizes of the protrusions become varied to cause failures potentially.

The coverage rate of the protrusions on a surface of each toner base particle is not particularly limited, so long as it is 10% to 90%, and may be appropriately selected depending on the intended purpose. It is preferably 20% to 70%. When this surface coverage rate is less than 10%, the effects brought by the protrusions cannot be obtained in some cases. When it is higher than 90%, there may be degradation in cleanability and increase in fixing temperature.

Figure 7:
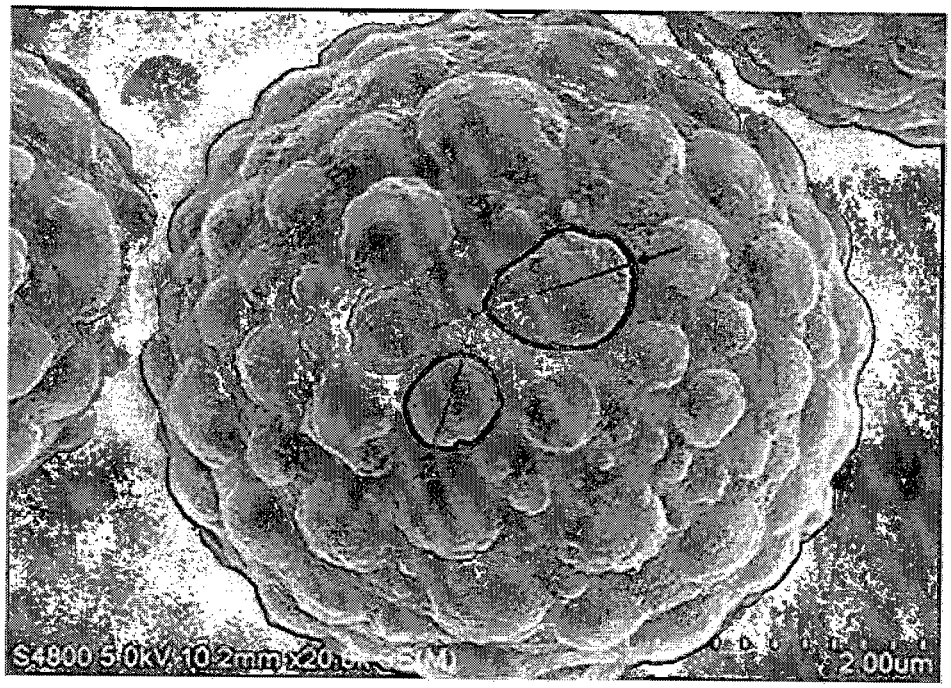
FIG. 7 is an explanatory view for a measuring method of long sides of protrusions of toner base particles of a toner of the present invention.

Next, description will be given to the calculation methods for long sides and coverage rate of the protrusions described in Examples with reference to FIGS. 1 and 7.

The length of the long side of the protrusion is measured from an SEM image of toner base particles obtained through observation under a scanning electron microscope (SEM).

The method for measuring the average length of the long sides of the protrusions is not particularly limited and may be appropriately selected depending on the intended purpose. The average length of the long sides of the protrusions is obtained as follows. Specifically, 100 or more toner base particles are selected for measurement, and at least 100 protrusions in total on the toner base particles are measured for length of the long side and the measured lengths are averaged (see FIG. 7).

The coverage rate of the protrusions on the toner base particle is measured from an SEM image of toner base particles obtained through observation under a scanning electron microscope (SEM).

Specifically, the shortest length between two parallel straight lines in contact with the toner base particle is determined, and the contact points are defined as A and B. Then, the area of a circle having as a center the center O of the line segment AB and having as a diameter the length of the line segment AO is calculated. The total area of the protrusions contained in the circle is calculated to obtain a coverage rate of the protrusions on the toner base particle (i.e., the total area of the protrusions/the area of the circle). The method for measuring the total area of the protrusions is not particularly limited and may be appropriately selected depending on the intended purpose. One hundred or more toner particles are calculated for coverage rate with the above method, and then the obtained coverage rates are averaged (see FIG. 1).

The area of the protrusions, the long side of the protrusions, and sphericity are measured with an image analysis-type particle size distribution analyzing software "MAC-VIEW" (product of Mountech Co., Ltd.).

<Toner Base Particles>

In the present invention, the term "toner base particle" refers to toner core particles having protrusions thereon and containing a binder resin and a colorant as essential ingredients. Also, the term "toner particle" refers to toner base particles on which external additives have been supported.

The toner of the present invention is obtained by adding external additives to toner base particles containing, as essential ingredients, a binder resin and a colorant, where the external additives are for improving various properties such as flowability, developability and chargeability.

Notably, the toner base particles may, if necessary, further contain other ingredients such as a releasing agent, a charge controlling agent and/or a plasticizer.

<<Binder Resin>>

The binder resin is not particularly limited and may be appropriately selected depending on the intended purpose. Examples thereof include polyester resins, polyurethane resins, polyurea resins, epoxy resins, and vinyl resins. Hybrid resins formed of chemically-bonded different resins may be used. Reactive functional groups may be introduced to the ends or side chains of resins, and bonded together to elongate in the process of preparing a toner to elongate. One type of the binder resin may be used, but preferably a resin of which the toner base particles are formed is different from a resin of which the protrusions are formed, in order to produce a toner having protrusions which have a uniform size.

—Resin of which the Toner Core Particles are Made—

The resin of which the toner core particles are made is not particularly limited and may be appropriately selected depending on the intended purpose. Examples of the resin include resins at least part of which is dissolved in the below-described organic solvents.

The acid value of the resin of which the toner core particles are made is not particularly limited and may be appropriately selected depending on the intended purpose, but is preferably 2 mgKOH/g to 24 mgKOH/g. When the acid value thereof exceeds 24 mgKOH/g, the resin is likely to transfer to the aqueous phase, resulting in loss of the resin through the production process or easily degrading the dispersion stability of oil droplets. Also, the toner may come to absorb a larger amount of water, leading to degradation of chargeability and storageability under high-temperature, high-humidity environment. Whereas when the acid value thereof is lower than 2 mgKOH/g, the polarity of the resin may become low, potentially making it difficult to uniformly disperse the colorant in the oil droplets.

The type of the resin of which the toner core particles are made is not particularly limited and may be appropriately selected depending on the intended purpose. However, when the resultant toner is used as a latent electrostatic image developing toner in electrophotography, a resin having a polyester skeleton is preferably used from the viewpoint of obtaining good fixing property.

The resin having a polyester skeleton is not particularly limited and may be appropriately selected depending on the intended purpose. Examples thereof include polyester resins and block copolymers of polyester resins and resins having other skeletons. Of these, polyester resins are preferably used since the obtained toner core particles have high uniformity.

——Polyester Resin——

The polyester resin is not particularly limited and may be appropriately selected depending on the intended purpose. Examples of the polyester resin include ring-opening polymers of lactones, polycondensates of hydroxycarboxylic acid, and polycondensates of polyols and polycarboxylic acids. Of these, polycondensates of polyols and polycarboxylic acids are preferred since a wide variety of polyesters can be formed.

The peak molecular weight of the polyester resin is not particularly limited and may be appropriately selected depending on the intended purpose. It is preferably 1,000 to 30,000, more preferably 1,500 to 10,000, particularly preferably 2,000 to 8,000. When the peak molecular weight is lower than 1,000, the heat resistance storage stability of the toner may be degraded. Whereas when the peak molecular weight exceeds 30,000, the low-temperature fixing property of the toner as latent electrostatic image developing toner may be degraded.

Also, the glass transition temperature of the polyester resin is not particularly limited and may be appropriately selected depending on the intended purpose. It is preferably 45° C. to 70° C., more preferably 50° C. to 65° C. When the glass transition temperature is lower than 45° C., the following failures may occur. Specifically, when the toner particles each containing protrusions and toner core particles covered therewith as in the present invention are stored under high-temperature, high-humidity environment, the protrusions may be plasticized by atmospheric moisture to cause a drop in glass transition temperature. The toner or toner cartridge is thought to be transported under high-temperature, high-humidity environment of 40° C. and 90%. Thus, the obtained toner particles may be deformed under application of a certain pressure or stick to each other. As a result, there is a possibility that the toner particles cannot behave as particles. Whereas when the glass transition temperature of the polyester resin exceeds 70° C., the toner particles may be degraded in low-temperature fixing property used as a latent electrostatic image developing toner.

——Polycondensates of Polyols and Polycarboxylic Acids——

———Polyol———

The polyol (1) is not particularly limited and may be appropriately selected depending on the intended purpose. Examples thereof include diols (1-1) and trihydric or higher polyols (1-2), with the diols (1-1) alone or a mixture containing the diols (1-1) and a small amount of the trihydric or higher polyols (1-2) being preferred.

The diols (1-1) are not particularly limited and may be appropriately selected depending on the intended purpose. Examples thereof include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as tetrafluorobisphenol A) and 2,2-bis(3-hydroxyphenyl)-1,1,1,3,3,3-hexafluoropropane; bis(4-hydroxyphenyl)ethers such as bis(3-fluoro-4-hydroxyphenyl)ether; and adducts of the above-listed bisphenols with alkylene oxides (e.g., ethylene oxide, propylene oxide and butylene oxide). Of these, preferred are C2 to C12 alkylene glycols and alkylene oxide adducts of bisphenols. Particularly preferred are combinations of alkylene oxide adducts of bisphenols and C2 to C12 alkylene glycols.

The trihydric or higher polyols (1-2) are not particularly limited and may be appropriately selected depending on the intended purpose. Examples thereof include trihydric to octahydric or higher aliphatic polyalcohols (e.g., glycerin, trimethylolethane, trimethylolpropane, pentaerythritol and sorbitol); trihydric or higher phenols (e.g., trisphenol PA, phenol novolac and cresol novolac); and alkylene oxide adducts of the above trihydric or higher polyphenols.

——Polycarboxylic Acid——

The polycarboxylic acid (2) is not particularly limited and may be appropriately selected depending on the intended purpose. Examples thereof include dicarboxylic acids (2-1) and trivalent or higher polycarboxylic acids (2-2), with the dicarboxylic acids (2-1) alone or a mixture containing the dicarboxylic acids (2-1) and a small amount of the trivalent or higher polycarboxylic acids (2-2) being preferred.

The dicarboxylic acids (2-1) are not particularly limited and may be appropriately selected depending on the intended purpose. Examples thereof include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid and hexafluoroisopropylidenediphthalic anhydride. Of these, preferred are C4 to C20 alkenylenedicarboxylic acids and C8 to C20 aromatic dicarboxylic acids.

The trivalent or higher polycarboxylic acids (2-2) are not particularly limited and may be appropriately selected depending on the intended purpose. Examples thereof include C9 to C20 aromatic polycarboxylic acids (e.g., trimellitic acid and pyromellitic acid). Notably, the polycarboxylic acids (2) may be reacted with polyols (1) using acid anhydrides or lower alkyl esters (e.g., methyl ester, ethyl ester and isopropyl ester) of the above carboxylic acids.

The ratio between polyol and polycarboxylic acid is not particularly limited and may be appropriately selected depending on the intended purpose. It is preferably 1/2 to 2/1, more preferably 1/1.5 to 1.5/1, particularly preferably 1/1.3 to 1.3/1, in terms of the equivalent ratio [OH]/[COOH] of the hydroxyl group [OH] to the carboxyl group [COOH].

—Modified Resin—

In order for the toner particles to have an increased mechanical strength and, when the toner particles are used as a latent electrostatic image developing toner, further involve no hot offset upon fixing, a modified resin containing an end isocyanate group may be dissolved in the oil phase to produce the toner particles.

The method for producing the modified resin is not particularly limited and may be appropriately selected depending on the intended purpose. Examples thereof include a method in which an isocyanate group-containing monomer is used for polymerization reaction to obtain an isocyanate group-containing resin; and a method in which a resin having an active hydrogen-containing group at its end is obtained through polymerization and then reacted with polyisocyanate to obtain a polymer containing an isocyanate group at its end. The latter method is preferred from the viewpoint of satisfactorily introducing an isocyanate group into the end of the polymer.

The active hydrogen-containing group is not particularly limited and may be appropriately selected depending on the intended purpose. Examples thereof include a hydroxyl group (i.e., an alcoholic hydroxyl group and a phenolic hydroxyl group), an amino group, a carboxyl group and a mercapto group, with an alcoholic hydroxyl group being preferred.

The skeleton of the modified resin is not particularly limited and may be appropriately selected depending on the intended purpose. Considering uniformity of particles, the skeleton of the modified resin is preferably the same as that of a resin dissolvable in the organic solvent. More preferably, the resin has a polyester skeleton.

The method for producing a polyester having an alcoholic hydroxyl group at its end is not particularly limited and may be appropriately selected depending on the intended purpose. Examples thereof include a method in which polycondensation reaction is performed between a polyol having more functional groups and a polycarboxylic acid having less functional groups.

——Amine Compound——

In the process of dispersing the oil phase in the aqueous phase to form particles, some isocyanate groups of the modified resin are hydrolyzed into amino groups, which are then reacted with unreacted isocyanate groups to allow elongation reaction to proceed. Also, an amine compound may be used in combination to reliably perform elongation reaction or introduce crosslinked points as well as the above reaction.

The amine compound (B) is not particularly limited and may be appropriately selected depending on the intended purpose. Examples thereof include diamines (B1), trivalent or higher polyamines (B2), aminoalcohols (B3), aminomercaptans (B4), amino acids (B5) and amino-blocked compounds (B6) obtained by blocking the amino groups of (B1) to (B5). Of these, preferred are diamines (B1) and mixtures containing diamines (B1) and a small amount of trivalent or higher polyamines (B2).

The diamines (B1) are not particularly limited and may be appropriately selected depending on the intended purpose. Examples thereof include aromatic diamines (e.g., phenylene diamine, diethyltoluene diamine, 4,4'-diaminodiphenylmethane, tetrafluoro-p-xylylenediamine and tetrafluoro-p-phenylenediamine); alicyclic diamines (e.g., 4,4'-diamino-3,3'-dimethyldicyclohexylmethane, diaminecyclohexane and isophorondiamine); and aliphatic diamines (e.g., ethylenediamine, tetramethylenediamine, hexamethylenediamine, dodecafluorohexylenediamine and tetracosafluorododecylenediamine).

The trivalent or higher polyamine (B2) is not particularly limited and may be appropriately selected depending on the intended purpose. Examples thereof include diethylenetriamine and triethylenetetramine.

The aminoalcohol (B3) is not particularly limited and may be appropriately selected depending on the intended purpose. Examples thereof include ethanolamine and hydroxyethylaniline.

The aminomercaptan (B4) is not particularly limited and may be appropriately selected depending on the intended purpose. Examples thereof include aminoethylmercaptan and aminopropylmercaptan.

The amino acid (B5) is not particularly limited and may be appropriately selected depending on the intended purpose. Examples thereof include aminopropionic acid and aminocaproic acid.

The amino-blocked compound (B6) obtained by blocking the amino groups of (B1) to (B5) is not particularly limited and may be appropriately selected depending on the intended purpose. Examples thereof include oxazolidine compounds and ketimine compounds derived from the amines (B1) to (B5) and ketones (e.g., acetone, methyl ethyl ketone and methyl isobutyl ketone).

The amount of the amine (B) relative to the amount of the isocyanate group-containing prepolymer (A) is not particularly limited and may be appropriately selected depending on the intended purpose. The number of amino groups [NHx] in the amine (B) is preferably four or less times, more preferably twice or less times, still more preferably 1.5 or less times, particularly preferably 1.2 or less times, the number of isocyanate groups [NCO] in the isocyanate group-containing prepolymer (A). When the number of amino groups [NHx] in the amine (B) is preferably more than four times the number of isocyanate groups [NCO] in the isocyanate group-containing prepolymer (A), excessive amino groups disadvantageously block isocyanate groups to prevent the elongation reaction of the modified resin. As a result, the polyester is decreased in molecular weight, resulting in degradation of hot offset resistance of the toner.

——Organic Solvent——

The organic solvent is not particularly limited and may be appropriately selected depending on the intended purpose. It is preferably a volatile organic solvent having a boiling point lower than 100° C. from the viewpoint of being easily removed. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. When the resin to be dissolved or dispersed in the organic solvent has a polyester skeleton, preferably used are ester organic solvents (e.g., methyl acetate, ethyl acetate and butyl acetate) or ketone organic solvents (e.g., methyl ethyl ketone and methyl isobutyl ketone) since these solvents have high dissolution capability to the resin. Among them, methyl acetate, ethyl acetate and methyl ethyl ketone are particularly preferred since these can be removed more easily.

<<Aqueous Medium>>

The aqueous medium is not particularly limited and may be appropriately selected depending on the intended purpose. Examples thereof include an aqueous medium containing water alone or an aqueous medium containing water and a water-miscible solvent in combination.

The water-miscible solvent is not particularly limited and may be appropriately selected depending on the intended purpose. Examples thereof include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

—Surfactant—

A surfactant is used for dispersing the oil phase in the aqueous medium to form liquid droplets.

The surfactant is not particularly limited and may be appropriately selected depending on the intended purpose. Examples thereof include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyl dimethyl ammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; amphoteric surfactants such as alanine, dodecyldi(aminoethyl)glycine, di(octylaminoethyl)glycine and N-alkyl-N, N-dimethylammonium betaine; and fluoroalkyl group-containing surfactants. Of these, fluoroalkyl group-containing surfactants are preferred since they can exhibit their dispersing effects even in a small amount.

The fluoroalkyl group-containing surfactant is not particularly limited and may be appropriately selected depending on the intended purpose. Examples thereof include fluoroalkyl group-containing anionic surfactants and fluoroalkyl group-containing cationic surfactants.

The fluoroalkyl group-containing anionic surfactant is not particularly limited and may be appropriately selected depending on the intended purpose. Examples thereof include fluoroalkyl carboxylic acids having 2 to 10 carbon atoms and metal salts thereof, disodium perfluorooctanesulfonylglutamate, sodium 3-[ω-fluoroalkyl(C6 to C11)oxy)-1-alkyl(C3 or C4) sulfonates, sodium 3-[ω-fluoroalkanoyl (C6 to C8)-N-ethylamino]-1-propanesulfonates, fluoroalkyl (C11 to C20) carboxylic acids and metal salts thereof, perfluoroalkylcarboxylic acids(C7 to C13) and metal salts thereof, perfluoroalkyl(C4 to C12)sulfonates and metal salts thereof, perfluorooctanesulfonic acid diethanol amide, N-propyl-N-(2-hydroxyethyl)perfluorooctanesulfone amide, perfluoroalkyl(C6 to C10)sulfonamide propyltrimethylammonium salts, salts of perfluoroalkyl(C6 to C10)-N-ethylsulfonylglycin and monoperfluoroalkyl(C6 to C16) ethylphosphates.

The fluoroalkyl group-containing cationic surfactant is not particularly limited and may be appropriately selected depending on the intended purpose. Examples thereof include aliphatic primary, secondary or tertiary amine acid containing a fluoroalkyl group, aliphatic quaternary ammonium salts (e.g., perfluoroalkyl(C6 to C10) sulfonamide propyltrimethylammonium salts), benzalkonium salts, benzethonium chloride, pyridinium salts and imidazolinium salts.

The concentration of the surfactant in the aqueous medium is not particularly limited and may be appropriately selected depending on the intended purpose. It is preferably 1% by mass to 10% by mass, more preferably 2% by mass to 8% by mass, particularly preferably 3% by mass to 7% by mass. When the concentration thereof is lower than 1% by mass, the oil droplets cannot be stably dispersed to form coarse oil droplets. Whereas when the concentration thereof exceeds 10% by mass, each oil droplet becomes too small and also has a reverse micellar structure. Thus, the dispersion stability is degraded due to the surfactant added in such an amount, to thereby easily form coarse oil droplets.

—Inorganic Dispersing Agent—

The dissolution or dispersion product of the toner composition may be dispersed in the aqueous medium in the presence of an inorganic dispersing agent or fine resin particles. Use of the inorganic dispersing agent is preferred since a sharp particle size distribution and a stable dispersion state can be attained.

The inorganic dispersing agent is not particularly limited and may be appropriately selected depending on the intended purpose. Examples thereof include tricalcium phosphate, calcium carbonate, titanium oxide, colloidal silica and hydroxyapatite.

—Polymeric Protective Colloid—

A polymeric protective colloid may be used to stabilize dispersed liquid droplets. The polymeric protective colloid is not particularly limited and may be appropriately selected depending on the intended purpose. Examples thereof include acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetone acrylamide and methylol compounds thereof, acid chlorides (e.g., acrylic acid chloride and methacrylic acid chloride); homopolymers or copolymers of nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed fine particles. Also, the calcium phosphate may be removed through enzymatic decomposition. Alternatively, the dispersing agent used may remain on the surfaces of the toner particles. However, the dispersing agent is preferably removed through washing after elongation and/or crosslinking reaction in terms of chargeability of the formed toner.

<<Colorant>>

The colorant is not particularly limited and may be appropriately selected depending on the intended purpose. Examples thereof include known dyes and pigments. Specific examples include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone and mixtures thereof.

—Masterbatch—

The colorant may be mixed with a resin to form a masterbatch.

The binder resin which is kneaded together with a masterbatch is not particularly limited and may be appropriately selected depending on the intended purpose. Examples thereof include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The method for preparing the masterbatch is not particularly limited and may be appropriately selected depending on the intended purpose. Examples thereof include a method in which a colorant and a resin for use in the preparation of a masterbatch are mixed and/or kneaded through application of high shearing force to prepare a masterbatch.

The mixing/kneading method is not particularly limited and may be appropriately selected depending on the intended purpose. Preferred is a method in which a high-shearing disperser (e.g., three-roll mill) is used for mixing/kneading.

Also, an organic solvent may be used for improving interactions between the colorant and the resin. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying has to be performed).

<External Additive>

The external additive used is fine inorganic particles whose surfaces have been treated with an amino group-containing silane coupling agent.

—Surface Treatment of Fine Inorganic Particles—

The method for treating the surfaces of the fine inorganic particles is not particularly limited and may be appropriately selected depending on the intended purpose. Examples thereof include a method for hydrophobizing the fine inorganic particles includes a method in which the fine inorganic particles are chemically treated with organic silicon compounds which react with the fine inorganic particles or to which the fine inorganic particles can be physically adsorbed.

In particular, preferred is a method in which the fine inorganic particles are oxidized by a halogenated metal compound in a vapor phase and then treated with organic silicon compounds.

The organic silicon compound is not particularly limited and may be appropriately selected depending on the intended purpose. Examples thereof include hexamethyl disilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, ρ-chloroethyltrichlorosilane, chloromethyldimethylchlorosilane, triorganosilylmercaptane, trimethylsilylmercaptane, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxane having 2 to 12 siloxane units per one molecule and, at each end moiety, a hydroxy group bonded to Si.

As described above, the fine inorganic particles are surface-treated with the amino group-containing silane coupling agent.

The amino group-containing silane coupling agent is not particularly limited and may be appropriately selected depending on the intended purpose. Examples thereof include aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, trimethoxysilyl-γ-propylbenzylamine, trimethoxysilyl-γ-propylpiperidine, trimethoxysilyl-γ-propylmorphorine, and trimethoxysilyl-γ-propylimidazole. These may be used alone or in combination.

The toner particles of the present invention contain as an external additive fine inorganic particles surface-treated with the amino group-containing silane coupling agent.

The fine inorganic particles surface-treated with the amino group-containing silane coupling agent have strong positive charges.

The fine inorganic particles hydrophobized with the amino group-containing silane coupling agent are transferred from the toner to a developer bearing member, and as a result the developer bearing member is covered with the fine inorganic particles. When the fine inorganic particles are the toner particles are frictionally charged, the toner particles are strongly negatively charged. Here, since the fine inorganic particles are gradually constantly supplied from the toner particles, it is possible to stabilize the chargeability of the toner for a long period of time. One possible measure to obtain this advantageous effect for a long period of time in a wide range is increasing the amount of the external additive. In this case, however, the external additive is easily exfoliated. As a result, although the effects commensurate with the increased amount are obtained initially and locally, it is difficult to obtain them for a long period of time in a wide range. In order to prevent exfoliation of the external additive, the external additive is preferably in contact with the toner particles. The surface areas of the toner particles are preferably increased in order for a certain amount of the external additive to be attached to the toner particles. As in the present invention, providing protrusions on the toner surfaces increases the surface areas of the toner particles, making it possible for the toner particles to carry a large amount of the external additive. In addition, the exfoliation of the external additive can be prevented by reducing the contact surface between the toner and the members. In this manner, remarkable effects can be obtained by combining together the toner particles having protrusions on the surfaces thereof and the external additive treated with the amino group-containing silane coupling agent.

When the fine inorganic particles treated with the amino group-containing silane coupling agent are used as an external additive, the amount of the fine inorganic particles in the total amount of the external additive is preferably 5% by mass to 30% by mass, more preferably 5% by mass or more but less than 30% by mass, particularly preferably 10% by mass or more but less than 20% by mass. When it is less than 5% by mass, the fine inorganic particles cannot exhibit their effects in some cases. Whereas when it is more than 30% by mass, the external additive comes to have high positive charges and thus the obtained toner particles does not function normally as the intended toner in some cases.

For the same reasons as described above, the amount of the fine inorganic particles treated with the amino group-containing silane coupling agent contained in the toner is preferably 0.1% by mass to 2.0% by mass, more preferably 0.2% by mass to 1.5% by mass.

—Fine Inorganic Particles—

The fine inorganic particles are not particularly limited and may be appropriately selected depending on the intended purpose. Examples thereof include silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, red oxide, antimony trioxide, magnesium oxide, zirconium oxide, barium sulfate, barium carbonate, silicon carbide and silicon nitride. Among these, silica and titanium oxide are particularly preferred.

The amount of the external additive contained in the toner is not particularly limited and may be appropriately selected depending on the intended purpose. It is preferably 1.0% by mass to 7.0% by mass, more preferably 2.0% by mass to 6.0% by mass.

The average particle diameter of primary particles of the fine inorganic particles is not particularly limited and may be appropriately selected depending on the intended purpose. It is preferably 100 nm or less, more preferably 80 nm or less. When the average particle diameter of the primary particles thereof is more than 100 nm, the obtained toner particles considerably decreases in flowability and also may be exfoliated easily. In addition, they may do damage the photoconductor surface ununiformly. Notably, the average particle diameter described here refers to a number average particle diameter.

The method for measuring the average particle diameter of the fine inorganic particles is not particularly limited and may be appropriately selected depending on the intended purpose. Examples thereof include a method in which the average particle diameter is measured with a particle size distribution analyzer utilizing dynamic light scattering (e.g., DLS-700 (product of Otsuka Electronics Co., Ltd.) and COULTER N4 (product of Coulter Electronics, Inc.). However, since it is difficult to dissociate the secondary aggregated fine particles after hydrophobizing treatment, preferable is directly determining the particle diameter using a photograph taken with a scanning electron microscope or a transmission electron microscope. More preferable is observing the external additives on the surface of the toner particles using a FE-SEM (field emission type scanning electron microscope) at a magnification of 100,000. In this case, it is preferable that at least 100 fine inorganic particles are observed to calculate an average length of major axes thereof. When the external additives are aggregated on the surfaces of the toner particles, the length of the major axis of each primary particle constituting the aggregation is measured.

The external additives are added to and mixed with the toner.

The mixing of the external additives with the toner is performed with a commonly used mixer for powder. Preferred is a mixer having a jacket to control the internal temperature thereof. In order to change a loading applied to the external additives, the external additives may be added gradually or during mixing, or the rotation number and rolling speed of the mixers, and the mixing time and the temperature may be changed. At first a high loading may be applied and then a relatively low loading may be applied, and vice versa. Examples of the usable mixers include a locking mixer, LOEDIGE MIXER, NAUTOR MIXER, and HENSHEL MIXER.

—Releasing Agent—

In order for the toner to have an increased releasing property during fixing when the toner is used as a latent electrostatic image developing toner, a releasing agent may be dispersed in the organic solvent.

The releasing agent is not particularly limited and may be appropriately selected depending on the intended purpose. Examples thereof include materials such as wax and silicone oil that exhibit a sufficiently low viscosity when heated during the fixing process and that are difficult to be compatible or swelled with other toner materials on the fixing member surface. Considering the storage stability of the toner particles themselves, preferably used is wax that exists as a solid in the colored resin particles during storage in general conditions.

The wax is not particularly limited and may be appropriately selected depending on the intended purpose. Examples thereof include long-chain hydrocarbon-containing waxes and carbonyl group-containing waxes.

The long-chain hydrocarbon-containing wax is not particularly limited and may be appropriately selected depending on the intended purpose. Examples thereof include polyolefin waxes (e.g., polyethylene wax and polypropylene wax); petroleum waxes (e.g., paraffin waxes, SASOL wax and microcrystalline waxes); and Fischer-Tropsch waxes.

The carbonyl group-containing wax is not particularly limited and may be appropriately selected depending on the intended purpose. Examples thereof include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., trimellitic acid tristearylamide); and dialkyl ketones (e.g., distearyl ketone).

Of these, long-chain hydrocarbon-containing waxes are preferred since they exhibit better releasing property. Furthermore, the long-chain hydrocarbon-containing waxes may be used in combination with the carbonyl group-containing waxes.

The amount of the releasing agent contained in the toner is not particularly limited and may be appropriately selected depending on the intended purpose. It is preferably 2% by mass to 25% by mass, more preferably 3% by mass to 20% by mass, particularly preferably 4% by mass to 15% by mass. When it is less than 2% by mass, the releasing agent cannot exhibit its effect of improving releasing property of the formed toner. Whereas when it is more than 25% by mass, the formed toner particles may be degraded in mechanical strength.

—Charge Controlling Agent—

If necessary, a charge controlling agent may be dissolved or dispersed in the organic solvent.

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorochemical surfactants, metal salts of salicylic acid, and metal salts of salicylic acid derivatives.

Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical Co., Ltd.), quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG), LRA-901 and boron complex LR-147 (these products are of Japan Carlit Co., Ltd.), copper phthalocyanine, perylene, quinacridone, azo pigments, and polymeric compounds having, a functional group such as a sulfonic acid group, carboxyl group, or quaternary ammonium salt.

The amount of the charge controlling agent contained in the toner is not particularly limited and may be appropriately selected depending on the intended purpose, so long as the charge controlling agent can exhibit its performances without degrading the fixing property of the toner. The amount thereof is preferably 0.5% by mass to 5% by mass, more preferably 0.8% by mass to 3% by mass.

<Production Method of Toner Base Particles>

The production method of toner base particles is not particularly limited and may be appropriately selected depending on the intended purpose. Examples thereof include known wet process granulation methods and pulverization methods such as a dissolution suspension method, a suspension polymerization method, and an emulsification aggregation method. Among these, a dissolution suspension method and an emulsification aggregation method are preferable in terms of easiness for controlling the particle diameter and shape of the toner base particles.

The method for producing toner base particles (serving as cores of toner particles) with the emulsification method and the suspension polymerization method is not particularly limited and may be appropriately selected depending on the intended purpose. Examples thereof include a method in which toner core particles (serving as cores of toner base particles) are obtained and then fine resin particles are added to the reaction system so that the fine resin particles are attached to or fused with the surfaces of the toner core particles.

Here, the reaction system may be heated to promote attachment and fusion of the fine resin particles. Also, use of a metal salt is effective in promoting the attachment and fusion.

—Fine Resin Particles—

The fine resin particles forming the protrusions in the present invention may be fine resin particles dispersed in the aqueous medium. The resin of the fine resin particles is not particularly limited and may be appropriately selected depending on the intended purpose. Examples thereof include vinyl resins, polyester resins, polyurethane resins, polyurea resins and epoxy resins. Of these, vinyl resins are preferred from the viewpoint of easily obtaining fine resin particles dispersed in the aqueous medium.

The method for preparing aqueous dispersoids of vinyl fine resin particles is not particularly limited and may be appropriately selected depending on the intended purpose. Examples thereof include polymerization methods such as an emulsification aggregation method, a suspension polymerization method and a dispersion polymerization method. Of these, an emulsification aggregation method is preferred from the viewpoint of easily obtaining particles having a particle diameter suitable for the present invention.

——Vinyl Fine Resin Particles——

The vinyl fine resin particles used in the present invention are not particularly limited and may be appropriately selected depending on the intended purpose. Examples thereof include a vinyl resin obtained through polymerization of a monomer mixture containing at least a styrene monomer.

In order for the toner particles to be used as charged functional particles like latent electrostatic image developing toner particles, the toner base particles each preferably have an easily chargeable surface.

The styrene monomer makes the surfaces of the toner base particles easily chargeable, since it has electron orbitals where electrons can stably travel as can be seen in aromatic ring structures.

The amount of the styrene monomer contained in the monomer mixture is not particularly limited and may be appropriately selected depending on the intended purpose. It is preferably 50% by mass to 100% by mass, more preferably 80% by mass to 100% by mass, particularly preferably 95% by mass to 100% by mass. When the amount of the styrene monomer is less than 50% by mass, the obtained toner base particles are poor in chargeability, which may impose limitation on applications of the toner base particles.

Here, the styrene monomer refers to an aromatic compound having a vinyl polymerizable functional group. Examples of the vinyl polymerizable functional group include a vinyl group, an isopropenyl group, an allyl group, an acryloyl group and a methacryloyl group.

The styrene monomer is not particularly limited and may be appropriately selected depending on the intended purpose. Examples thereof include styrene, α-methylstyrene, 4-methylstyrene, 4-ethylstyrene, 4-tert-butylstyrene, 4-methoxystyrene, 4-ethoxystyrene, 4-carboxystyrene and metal salts thereof, 4-styrenesulfonic acid and metal salts thereof; 1-vinylnaphthalene, 2-vinylnaphthalene, allylbenzene, phenoxyalkylene glycol acrylates, phenoxyalkylene glycol methacrylates, phenoxypolyalkylene glycol acrylates and phenoxypolyalkylene glycol methacrylates. Of these, styrene is preferably used since it is easily available, and has excellent reactivity and high chargeability.

Also, an acid monomer may be contained in the monomer mixture when the fine vinyl resin particles are obtained. The amount of the acid monomer contained in the monomer mixture is not particularly limited and may be appropriately selected depending on the intended purpose. It is preferably 0% by mass to 7% by mass, more preferably 0% by mass to 4% by mass, particularly preferably 0% by mass; i.e., no acid monomer is contained. When it is more than 7% by mass, the vinyl fine resin particles are easily exfoliated from the toner base particles. Since the vinyl fine resin particles themselves have high dispersion stability. Thus, when such vinyl fine resin particles are added to the dispersion liquid containing oil droplets dispersed in the aqueous phase, they are difficult to attach thereonto at ambient temperature. Or, even when the vinyl fine resin particles have been attached thereonto, they tend to be exfoliated through the process of removal of the solvent, washing, drying and addition of external additives. Whereas when the amount of the acid monomer contained in the monomer mixture is 4% by mass or less, the obtained toner base particles less changes in chargeability depending on the working environment.

Here, the acid monomer refers to a compound having an acid group and a vinyl polymerizable functional group. The acid group is not particularly limited and may be appropriately selected depending on the intended purpose. Examples thereof include carboxylic acid, sulfonic acid and phosphoric acid.

The acid monomer is not particularly limited and may be appropriately selected depending on the intended purpose. Examples thereof include carboxyl group-containing vinyl monomers and salts thereof (e.g., (meth)acrylic acid, maleic acid or maleic anhydride, monoalkyl maleates, furaaric acid, monoalkyl fumarates, crotonic acid, itaconic acid, monoalkyl itaconates, glycol itaconate monoethers, citraconic acid, monoalkyl citraconates and cinnamic acid), sulfonic acid group-containing vinyl monomers and salts thereof, vinyl sulfuric acid monoesters and salts thereof, and phosphoric acid group-containing vinyl monomers and salts thereof. Of these, preferred are (meth)acrylic acid, maleic acid or maleic anhydride, monoalkyl maleates, fumaric acid and monoalkyl fumarates.

Also, a monomer having an ethylene oxide (EO) chain may be used for controlling compatibility to the toner core particles. The monomer having an ethylene oxide (EO) chain is not particularly limited and may be appropriately selected depending on the intended purpose. Examples thereof include phenoxy alkylene glycol acrylates, phenoxy alkylene glycol methacrylates, phenoxy polyalkylene glycol acrylates and phenoxy polyalkylene glycol methacrylates.

The amount of the monomer having an ethylene oxide (EO) chain used is not particularly limited and may be appropriately selected depending on the intended purpose, but preferably 10% by mass or less, more preferably 5% by mass or less, particularly preferably 2% by mass or less, relative to the total amount of the monomers. When the amount thereof is more than 10% by mass, an increased number of polar groups on the surfaces of the toner base particles considerably degrade charge stability to the environment, which is not preferred. In addition, the compatibility to the toner core particles becomes too high, resulting in that the embedment rate of the protrusions becomes high and as a result the coverage rate of the surfaces of the toner base particles with the protrusions tends to be low.

Also, a monomer having an ester bond may be used for controlling compatibility to the toner core particles. The monomer having an ester bond is not particularly limited and may be appropriately selected depending on the intended purpose. Examples thereof include 2-acryloyloxyethyl succinate and 2-methacryloyloxyethyl phthalate.

The amount of the monomer having an ester bond used is not particularly limited and may be appropriately selected depending on the intended purpose, but preferably 10% by mass or less, more preferably 5% by mass or less, particularly preferably 2% by mass or less, relative to the total amount of the monomers. When the amount thereof is more than 10% by mass, an increased number of polar groups on the surfaces of the toner base particles considerably degrade charge stability to the environment, which is not preferred. In addition, the compatibility to the toner core particles becomes too high, resulting in that the embedment rate of the protrusions becomes high and the coverage rate of the surfaces of the toner base particles with the protrusions tends to be low.

The method for obtaining the vinyl fine resin particles is not particularly limited and may be appropriately selected depending on the intended purpose. Examples thereof include the following methods (a) to (f):

(a) a method in which a monomer mixture is allowed to undergo polymerization reaction with a suspension polymerization method, an emulsification polymerization method, a seed polymerization method or a dispersion polymerization method, to thereby produce a dispersion liquid of vinyl fine resin particles;

(b) a method in which a monomer mixture is allowed to undergo polymerization, and the obtained resin is then pulverized using a fine pulverizer of, for example, mechanically rotating type or jetting type, followed by classifying, to thereby produce fine resin particles;

(c) a method in which a monomer mixture is allowed to undergo polymerization, and the obtained resin is then dissolved in a solvent, followed by spraying of the resultant resin solution, to thereby produce fine resin particles;

(d) a method in which a monomer mixture is allowed to undergo polymerization, the obtained resin is dissolved in a solvent, another solvent is added to the resultant resin solution to precipitate fine resin particles, and then the solvent is removed to obtain fine resin particles; or a method in which a monomer mixture is allowed to undergo polymerization, the obtained resin is dissolved in a solvent with heating, the resultant resin solution is cooled to precipitate fine resin particles, and then the solvent is removed to obtain fine resin particles;

(e) a method in which a monomer mixture is allowed to undergo polymerization, the obtained resin is dissolved in a solvent, the resultant resin solution is dispersed in an aqueous medium in the presence of an appropriate dispersing agent, and then the dispersion liquid is, for example, heated or left under reduced pressure; and (f) a method in which a monomer mixture is allowed to undergo polymerization, the obtained resin is dissolved in a solvent, an appropriate emulsifying agent is dissolved in the resultant resin solution, followed by phase-transfer emulsification with the addition of water.

Of these, method (a) is preferably employed, since fine resin particles can easily be produced as a dispersion liquid, which is easy to use for the next step.

In the polymerization reaction of method (a), preferably, (i) a dispersion stabilizer is added to the aqueous medium, (ii) the monomer mixture to be allowed to undergo polymerization reaction is made to contain a monomer capable of imparting dispersion stability to the fine resin particles obtained through polymerization (i.e., a reactive emulsifier) or the above (i) and (ii) are performed in combination, to thereby impart dispersion stability to the obtained vinyl fine resin particles.

When neither the dispersion stabilizer nor the reactive emulsifier is used, the particles cannot be maintained in a dispersion state and as a result the vinyl resin cannot be obtained as fine particles in some cases.

In addition, when neither the dispersion stabilizer nor the reactive emulsifier is used, the obtained fine resin particles are poor in dispersion stability whereby they are poor in storage stability resulting in aggregation during storage.

Furthermore, when neither the dispersion stabilizer nor the reactive emulsifier is used, the particles are degraded in dispersion stability at the below-described fine resin particle-attaching step whereby the core particles easily aggregate or combined together resulting in that the finally obtained toner base particles are degraded in evenness of, for example, particle diameter, shape, and surface.

The dispersion stabilizer is not particularly limited and may be appropriately selected depending on the intended purpose. Examples thereof include surfactants and inorganic dispersing agents.

The surfactant is not particularly limited and may be appropriately selected depending on the intended purpose. Examples thereof include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi (aminoethyl)glycine, di(octylaminoethyl)glycine and N-alkyl-N,N-dimethylammonium betaine.

The inorganic dispersing agent is not particularly limited and may be appropriately selected depending on the intended purpose. Examples thereof include tricalcium phosphate, calcium carbonate, titanium oxide, colloidal silica and hydroxyapatite.

The weight average molecular weight of the vinyl resin is not particularly limited and may be appropriately selected depending on the intended purpose. The weight average molecular weight thereof is preferably 3,000 to 300,000, more preferably 4,000 to 100,000, particularly preferably 5,000 to 50,000. When the weight average molecular weight is lower than 3,000, the vinyl resin has low mechanical strength (i.e., is brittle). Thus, the surfaces of the finally obtained toner base particles easily change depending on the working environment or some applications. For example, the obtained toner particles considerably changes in chargeability and/or causes contamination such as attachment onto the surrounding members, which leads to degradation of image quality. Whereas when the weight average molecular weight is higher than 300,000, the number of ends of the molecules is decreased, so that the molecular chains interact with the toner core particles to a less extent to degrade adhesion to the toner core particles, which is not preferred.

The glass transition temperature (Tg) of the vinyl resin is not particularly limited and may be appropriately selected depending on the intended purpose. It is preferably 45° C. to 100° C., more preferably 55° C. to 90° C., particularly preferably 65° C. to 80° C. When the glass transition temperature (Tg) is lower than 45° C., the following problems may occur. Specifically, when the toner particles are stored under high-temperature, high-humidity environment, the resin of the protrusions of the toner particles may be plasticized by atmospheric moisture to cause a drop in glass transition temperature. The toner or toner cartridge is thought to be transported under high-temperature, high-humidity environment of 40° C. and 90%. Thus, the obtained toner base particles may be deformed under application of a certain pressure or stick to each other. As a result, there is a possibility that the toner particles cannot behave as particles. Whereas when the glass transition temperature (Tg) of the vinyl resin is higher than 100° C., the toner particles may be degraded in fixing property. Both cases are not preferred.

<Preparation Step of Oil Phase>

The method for preparing an oil phase, which contains an organic solvent, and materials such as a resin and a colorant dissolved or dispersed in the organic solvent, is not particularly limited and may be appropriately selected depending on the intended purpose. Examples thereof include a method in which the materials such as the resin and the colorant are gradually added to the organic solvent under stirring so that these materials are dissolved or dispersed therein. Notably, when a pigment is used as the colorant and/or when the materials such as the releasing agent and the charge controlling agent used are poorly dissolvable to the organic solvent, the particles of these materials are preferably micronized before the addition to the organic solvent.

As described above, the colorant may be formed into a masterbatch. Similarly, the materials such as the releasing agent and the charge controlling agent may be formed into a masterbatch.

In another means, the colorant, the releasing agent and the charge controlling agent may be dispersed through a wet process in the organic solvent, if necessary in the presence of a dispersion aid, to thereby obtain a wet master.

In still another means, when dispersing the materials melted at a temperature lower than the boiling point of the organic solvent, they are heated under stirring in the organic solvent, if necessary in the presence of a dispersion aid to be stirred together with the dispersoids; and the resultant solution is cooled with stirring or shearing so that the dissolved materials are crystallized, to thereby produce microcrystals of the dispersoids.

After the colorant, releasing agent and charge controlling agent, dispersed with any of the above means, have been dissolved or dispersed in the organic solvent together with a resin, the resultant mixture may be further dispersed. The dispersing method is not particularly limited and may be appropriately selected depending on the intended purpose. Examples thereof include a method using, for example, a bead mill or a disc mill.

<Preparation Step of Toner Core Particles>

In this step, the oil phase obtained in the above-described step is dispersed in an aqueous medium containing at least a surfactant to prepare a dispersion liquid containing toner core particles of the oil phase.

The dispersing method is not particularly limited and may be appropriately selected depending on the intended purpose. Examples thereof include a method using, for example, a low-speed shearing disperser, a high-speed shearing disperser, a friction disperser, a high-pressure jet disperser or an ultrasonic disperser.

The particle diameter of the dispersoids is not particularly limited and may be appropriately selected depending on the intended purpose. It is preferably 2 μm to 20 μm considering using a high-speed shearing disperser.

The rotation speed of the high-speed shearing disperser is not particularly limited and may be appropriately selected depending on the intended purpose. It is preferably 1,000 rpm to 30,000 rpm, more preferably 5,000 rpm to 20,000 rpm.

The dispersion time is not particularly limited and may be appropriately selected depending on the intended purpose. It is generally 0.1 min to 5 min in a batch method. When the dispersion time is longer than 5 min, unwanted small particles remain, and also the dispersion is excessively performed to make the dispersion system unstable, potentially forming aggregates and coarse particles, which is not preferred.

The dispersion temperature is not particularly limited and may be appropriately selected depending on the intended purpose. It is preferably 0° C. to 40° C., more preferably 10° C. to 30° C. When the dispersion temperature is higher than 40° C., molecular movements are excited to degrade dispersion stability, easily forming aggregates and coarse particles, which is not preferred. Whereas when the dispersion temperature is lower than 0° C., the dispersion liquid is increased in viscosity to require elevated energy for dispersion, leading to a drop in production efficiency.

The surfactant usable may be the same as those mentioned in the above-described production method of the fine resin particles. In order to efficiently disperse the oil droplets containing the solvent, the surfactant used is preferably a disulfonic acid salt having a relatively high HLB.

The concentration of the surfactant in the aqueous medium is not particularly limited and may be appropriately selected depending on the intended purpose, but is preferably lower in order to form desired protrusions in the below-described fine resin particle attachment step. Specifically, the concentration of a surfactant in the aqueous medium is preferably 3% by mass to 7% by mass. The reason for this is thought to lie in the following. That is, presumably, the fine resin particles are incorporated into each toner core particle where they are swelled, and the fine resin particles are localized on the surfaces of the toner core particles upon removal of the organic solvent in the below-described desolvation step. When the concentration of the surfactant is too high, the wettability of the surfaces of the toner core particles becomes too high. As a result, the fine resin particles are not incorporated and remain on the surfaces of the toner core particles or the dispersion solvent.

Or, even when incorporated into the toner core particles, the fine resin particles are released from the toner core particles upon localization on the surface.

<Fine Resin Particle Attachment Step>

The dissolution suspension method may be performed as described above. However, the following method is preferably employed since the fine resin particles are attached onto or fused with the toner core particles more firmly. Specifically, the method includes dissolving or dispersing materials of the toner core particles in an organic solvent to prepare an oil phase, dispersing the oil phase in an aqueous medium, and adding fine resin particles so as to be attached onto and fused with the surfaces of the toner core particles to obtain a toner base particle dispersion liquid. Addition of the fine resin particles at the production step of toner core particles forms large, ununiform protrusions, which cannot be preferred in some cases.

The obtained toner core particle dispersion liquid contains stable liquid droplets of the toner core particles, so long as the dispersion liquid is being stirred. For attaching the fine resin particles onto the toner core particles, the fine resin particle dispersion liquid is added to this core particle slurry. The period for which the vinyl fine resin particle dispersion liquid is added is preferably 30 sec or longer. When it is added for 30 sec or shorter, the dispersion system drastically changes to form aggregated particles. In addition, the vinyl fine resin particles are ununiformly attached onto the core particles, which is not preferred. Meanwhile, adding the vinyl fine resin particle dispersion liquid over an unnecessarily long period of time (e.g., 60 min or longer) cannot be preferred in some cases from the viewpoint of lowering production efficiency.

Before added to the core particle dispersion liquid, the vinyl fine resin particle dispersion liquid may be appropriately diluted or concentrated so as to have a desired concentration.

The concentration of the vinyl fine resin particle dispersion liquid is not particularly limited and may be appropriately selected depending on the intended purpose, but is preferably 5% by mass to 30% by mass, more preferably 8% by mass to 20% by mass. When the concentration is less than 5% by mass, the concentration of the organic solvent greatly changes upon addition of the dispersion liquid to lead to insufficient attachment of the fine resin particles, which cannot be preferred in some cases. Also, when the concentration exceeds 30% by mass, the fine resin particles tend to be localized in the toner core particle dispersion liquid, resulting in that the fine resin particles are ununiformly attached onto the toner core particles, which cannot be preferred in some cases.

The following may explain the reason why the vinyl fine resin particles are sufficiently firmly attached onto the toner core particles by the method of the present invention. Specifically, when the vinyl fine resin particles are attached onto the liquid droplets of the core particles, the core particles can freely deform to sufficiently form contact surfaces with the vinyl fine resin particles and the vinyl fine resin particles are swelled with or dissolved in the organic solvent to make it easier for the vinyl fine resin particles to adhere to the resin in the core particles. Therefore, in this state, the organic solvent must exist in the system in a sufficiently large amount. In the toner core particle dispersion liquid, the amount of the organic solvent is preferably 50% by mass to 150% by mass, more preferably 70% by mass to 125% by mass, relative to the amount of the solid matter (e.g., resin, colorant, releasing agent and charge controlling agent). When the amount of the organic solvent exceeds 150% by mass, the amount of the colored resin particles obtained through one production process is reduced, resulting in low production efficiency. Also, a large amount of the organic solvent impairs dispersion stability, making it difficult to attain stable production, which cannot be preferred in some cases.

The temperature at which the vinyl fine resin particles are made to attach onto the toner core particles is not particularly limited and may be appropriately selected depending on the intended purpose, but is preferably 10° C. to 60° C., more preferably 20° C. to 45° C. When it exceeds 60° C., required energy for production is elevated to increase environmental loading, and the presence of vinyl fine resin particles having a low acid value on the surfaces of liquid droplets makes the dispersion system to be unstable to thereby potentially form coarse particles. Meanwhile, when it is less than 10° C., the dispersion liquid is increased in viscosity, leading to an insufficiently attachment of the fine resin particles. Needless to say, both cases are not preferred.

The rate of a mass of the resin of which the protrusions are made to a total mass of the toner is not particularly limited and may be appropriately selected depending on the intended purpose, but is preferably 1% to 20%, more preferably 3% to 15%, particularly preferably 5% to 10%. When it is less than 1%, the effects of the protrusions are not sufficient. Whereas when it is more than 20%, excessive fine resin particles are weakly attached onto the toner core particles, causing, for example, filming.

Examples of the method employable in the fine resin particle attachment step include a method in which the toner base particles and the fine resin particles are mixed together with stirring so that the fine resin particles are mechanically attached or coated on the toner base particles.

<Desolvation Step>

In order to remove the organic solvent from the obtained toner base particle dispersion liquid, the entire system may be gradually increased in temperature with stirring, to thereby completely evaporate off the organic solvent contained in the liquid droplets.

Alternatively, the obtained toner base particle dispersion liquid with stirring may be sprayed toward a dry atmosphere, to thereby completely evaporate off the organic solvent contained in the liquid droplets.

Still alternatively, the toner base particle dispersion liquid may be reduced in pressure with stirring to evaporate off the organic solvent.

Each of the latter two means may be used in combination with the first means.

The dry atmosphere toward which the emulsified dispersion liquid is to be sprayed uses heated gas (e.g., air, nitrogen, carbon dioxide and combustion gas), especially, gas flow heated to a temperature equal to or higher than the highest boiling point of the solvents used. By removing the organic solvent even in a short time using, for example, a spray dryer, a belt dryer or a rotary kiln, the resultant product has satisfactorily desired quality.

<Aging Step>

When a modified resin having an end isocyanate group is added, an aging step may be performed to allow elongation or crosslinking reaction of the isocyanate to proceed.

The aging time is generally 10 min to 40 hours, preferably 2 hours to 24 hours.

The aging temperature is generally 0° C. to 65° C., preferably 35° C. to 50° C.

<Washing Step>

The dispersion liquid of the toner base particles obtained in the above-described manner contains not only the toner base particles but also subsidiary materials such as a dispersing agent (e.g., a surfactant). Thus, the dispersion liquid is washed to separate the toner base particles from the subsidiary materials. Examples of the washing method for separating the toner base particles include a centrifugation method, a reduced-pressure filtration method and a filter press method, but employable washing methods in the present invention are not limited thereto. Any of the above methods forms a cake of the toner base particles. If the toner base particles are not sufficiently washed through only one washing process, the formed cake may be dispersed again in an aqueous solvent to form a slurry, which is repeatedly treated with any of the above methods to taken out the toner base particles. When a reduced-pressure filtration method or a filter press method is employed for washing, an aqueous solvent may be made to penetrate the cake to wash out the subsidiary materials contained in the toner base particles. The aqueous solvent used for washing is water or a solvent mixture of water and an alcohol such as methanol or ethanol. Use of only water is preferred from the viewpoint of reducing cost and environmental load caused by, for example, drainage treatment.

<Drying Step>

The washed toner base particles containing the aqueous medium in a large amount are dried to remove the aqueous medium, whereby only toner base particles can be obtained.

The drying method can be performed using, for example, a spray dryer, a vacuum freezing dryer, a reduced-pressure dryer, a ventilation shelf dryer, a movable shelf dryer, a fluidized-bed-type dryer, a rotary dryer or a stirring-type dryer.

The toner base particles are preferably dried until the water content is finally decreased less than 1% by mass.

Also, when the dry toner base particles flocculate to cause inconvenience in use, the flocculated particles may be separated from each other through beating using, for example, a jet mill, HENSCHEL MIXER, a super mixer, a coffee mill, an oster blender or a food processor.

—Volume Average Particle Diameter of Toner—

The volume average particle diameter of the toner is not particularly limited and may be appropriately selected depending on the intended purpose. It is preferably 3 μm to 9 μm, more preferably 4 μm to 8 μm, particularly preferably 4 μm to 7 μm, in terms of being able to be charged uniformly and sufficiently. The toner particles having a volume average particle diameter less than 3 μm are relatively increased in toner adhesion force, which cannot be preferred in some cases since the operability of the toner particles is reduced under an electrical field. The toner particles having a volume average particle diameter exceeding 9 μm form an image whose image qualities (e.g., reproducibility of thin lines) may be degraded.

Also, in the toner particles, the ratio of the volume average particle diameter to the number average particle diameter (volume average particle diameter/number average particle diameter) is not particularly limited and may be appropriately selected depending on the intended purpose. It is preferably 1.25 or less, more preferably 1.20 or less, still more preferably 1.17 or less. When the ratio exceeds 1.25; i.e., the toner particles have low uniformity in particle diameter, the size or height of the protrusions tends to be varied. In addition, during repetitive use, toner particles having a large particle diameter or, in some cases, toner particles having small particle diameter are preferentially consumed, so that the average particle diameter of the toner particles remaining in the developing device is changed from that of the toner particles at an initial state. Thus, the developing conditions initially set are not optimal for development of the remaining toner particles. As a result, various unfavorable phenomena tend to occur including charging failure, considerable increase or decrease of the amount of toner particles conveyed, toner clogging and toner leakage.

Examples of employable apparatus for measuring the particle size distribution of the toner particles include a COULTER COUNTER TA-II and COULTER MULTISIZER II (these products are of Coulter, Inc.). The measurement method will next be described.

First, a surfactant (0.1 mL to 5 mL), preferably an alkylbenzene sulfonic acid salt, is added as a dispersing agent to an electrolyte solution (100 mL to 150 mL). Here, the electrolyte solution is an about 1% by mass aqueous NaCl solution prepared using the 1st grade sodium chloride, and examples of commercially available products thereof include ISOTON-II (product of Coulter, Inc.). Subsequently, a measurement sample (2 mg to 20 mg) is suspended in the above-obtained electrolyte solution. The resultant electrolyte solution is dispersed with an ultrasonic wave disperser for about 1 min to about 3 min. The thus-obtained dispersion liquid is analyzed with the above-described apparatus using an aperture of 100 μm to measure the number and the volume of the toner or toner particles. Then, the volume particle size distribution and the number particle size distribution are calculated from the obtained values. From these distributions, the volume average particle diameter (D4) and the number average particle diameter (D1) of the toner can be obtained.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

—Average Sphericity of Toner—

The average sphericity of the toner is not particularly limited and may be appropriately selected depending on the intended purpose, but is preferably 0.930 or more, more preferably 0.950 or more, particularly preferably 0.970 or more. When the average sphericity is less than 0.930, the external additives are accumulated in concave portions to prevent the silicone oil from sufficiently being supplied. Also, the toner having an average sphericity less than 0.930 is poor in flowability to easily cause failures upon development as well as to be degraded in transfer efficiency. Needless to say, both cases are not preferred.

The average sphericity of the toner particles can be measured using a flow-type particle image analyzer FPIA-2000. Specifically, 0.1 mL to 0.5 mL of a surfactant (preferably an alkylbenzene sulfonic acid salt) is added as a dispersing agent into 100 mL to 150 mL of water in a container, from which solid impurities have previously been removed. Then, about 0.1 g to about 0.5 g of a measurement sample is added to the container, followed by dispersing. The resultant suspension is subjected to dispersing treatment by an ultrasonic disperser for about 1 min to about 3 min, and the concentration of the dispersion liquid is adjusted such that the number of particles of the sample is 3,000 per microliter to 10,000 per microliter. In this state, the shape and distribution of the toner are measured using the above analyzer.

—Measurement of Particle Diameter of Fine Vinyl Resin Particles—

The particle diameter of the fine resin particles was measured using UPA-150EX (product of NIKKISO CO., LTD.).

The average particle diameter of the fine resin particles is not particularly limited and may be appropriately selected depending on the intended purpose, but is preferably 50 nm to 200 nm, more preferably 80 nm to 160 nm, particularly preferably 100 nm to 140 nm. When the particle diameter is smaller than 50 nm, it is difficult to form sufficiently large protrusions on the toner surface. When the particle diameter exceeds 200 nm, the formed protrusions become ununiform, which is not preferred.

Also, the ratio of the volume average particle diameter to the number average particle diameter (volume average particle diameter/number average particle diameter) of the fine resin particles is preferably 1.25 or less, more preferably 1.20 or less, still more preferably 1.17 or less. When the particle diameter of the fine resin particles exceeds 1.25; i.e., the fine resin particles are poor in uniformity of particle diameter, the size of the formed protrusions tends to be varied.

—Rate of the Mass of the Resin of which the Protrusions are Made with Respect to the Total Mass of the Toner—

The rate of the mass of the resin of which the protrusions are made with respect to the total mass of the toner is obtained as follows. Specifically, the toner is mixed with a two-liquid curable epoxy resin, followed by curing. The resultant cured product is formed with a microtome into a thin section. The formed thin section is observed under a scanning transmission electron microscope (STEM), and the obtained STEM image is used to measure the rate. In 100 or more toner particles, the portion occupied with the resin of which the protrusions are made and the other portion are binarized to calculate the rate of the area occupied with the protrusions. The obtained value is defined as the rate of the mass of the resin of which the protrusions are made with respect to the total mass of the toner. The areas of the toner particles and the protrusions were measured with an image analysis-type particle size distribution analyzing software "MAC-VIEW" (product of Mountech Co., Ltd.). When the resin of which the protrusions are made is difficult to observe, the toner particles and the protrusions may be stained with, for example, ruthenium tetraoxide.

The method for measuring the areas of the toner particles and the protrusions is not particularly limited and may be appropriately selected depending on the intended purpose.

—Measurement of Molecular Weight (GPC)—

The molecular weight of the resin was measured through GPC (gel permeation chromatography) under the following conditions.

Apparatus: GPC-150C (product of Waters Co.)
Column: KF801 to 807 (product of Shodex Co.)
Temperature: 40° C.
Solvent: THF (tetrahydrofuran)
Flow rate: 1.0 mL/min
Sample injected: 0.1 mL of a sample having a concentration of 0.05% to 0.6%

From the molecular weight distribution of the resin measured under the above conditions, the number average molecular weight and the weight average molecular weight of the resin were calculated using a molecular weight calibration curve obtained from monodispersed polystyrene standard samples. The standard polystyrene samples used for obtaining the calibration curve were toluene and Std. Nos. S-7300, S-210, S-390, S-875, S-1980, S-10.9, S-629, S-3.0 and S-0.580 of Showdex STANDARD (product of SHOWA DENKO K.K.). The detector used was a RI (refractive index) detector.

—Measurement of Glass Transition Temperature (Tg) (DSC)—

The Tg was measured using TG-DSC system TAS-100 (product of Rigaku Denki Co., Ltd.). First, a sample (about 10 mg) is placed in an aluminum container, which is placed on a holder unit. The holder unit is then set in an electric oven. The sample is heated from room temperature to 150° C. at a temperature increasing rate of 10° C./min, left to stand at 150° C. for 10 min, cooled to room temperature, and left to stand for 10 min. In a nitrogen atmosphere, the sample is heated again to 150° C. at a temperature increasing rate of 10° C./min for DSC analysis. Using the analysis system of TAS-100 system, the Tg is calculated from the tangent point between the base line and the tangential line of the endothermic curve near the Tg.

—Measurement of Concentration of Solid Matter—

The concentration of solid matter contained in the oil phase was measured as follows.

An aluminum plate (about 1 g to about 3 g) is accurately weighed in advance. About 2 g of the oil phase is placed on the aluminum plate within 30 sec, and then the oil phase placed thereon is accurately weighed. The aluminum plate is placed for 1 hour in an oven set to 150° C. to evaporate the solvent. Thereafter, the aluminum plate is taken out from the oven and left to cool. Subsequently, the total mass of the aluminum plate and solid matter of the oil phase is measured with an electronic balance. The mass of the aluminum plate is subtracted from the total mass of the aluminum plate and the solid matter contained in the oil phase to obtain the mass of the solid matter contained in the oil phase, which is divided by the mass of the oil phase placed on the aluminum plate to obtain the concentration of the solid matter contained in the oil phase. Also, the ratio of the solvent to the solid matter contained in the oil phase is a value obtained from the following: (the mass of the oil phase—the mass of the solid matter contained in the oil phase); i.e., the mass of the solvent/the mass of the solid matter contained in the oil phase.

—Measurement of Acid Value—

The acid value of the resin is measured according to JIS K1557-1970, which will be specifically described below. About 2 g of a pulverized sample is accurately weighed (W(g)). The sample is added to a 200 mL conical flask. Then, 100 mL of a solvent mixture of toluene/ethanol (2:1) is added to the flask. The resultant mixture is left to stand for 5 hours for dissolution. A phenolphthalein solution serving as an indicator is added to the solution. The resultant solution is titrated with 0.1N alcohol solution of potassium hydroxide. The amount of the KOH solution is defined as S (mL). A blank test is performed, and the amount of the KOH solution is defined as B (mL).

The acid value is calculated using the following equation:

$$\text{Acid value}=[(S-B)\times f\times 5.61]/W$$

where f denotes a factor of the KOH solution.

The toner of the present invention may be used as a one-component developer or a two-component developer composed of an electrostatic image developing toner and an electrostatic image developing carrier. The developer of the present invention can provide excellent durability, keep chargeability over a long time, and stably form high-quality images.

Notably, the electrostatic image developing carrier (carrier) used for the electrophotographic developer of the present invention is not particularly limited, but includes a carrier core material coated with a coating layer containing a binder resin and electric conductive fine particles.

The carrier core material is not particularly limited, and known electrophotographic two-component carriers may be appropriately selected and used depending on the application and intended purpose such as ferrite, Cu—Zn ferrite, Mn ferrite, Mn—Mg ferrite, Mn—Mg—Sr ferrite, magnetite, iron, and nickel.

Also, the toner of the present invention may be charged into a container before use. The toner container containing the toner becomes stable to, for example, changes in environment, allowing simple and easy handling. This usage form also leads to prevention of contamination of the apparatus.

(Process Cartridge)

The toner of the present invention can be suitably used for the process cartridge of the present invention.

A process cartridge of the present invention includes at least a latent electrostatic image bearing member and a developing unit configured to develop a latent electrostatic image formed on the latent electrostatic image bearing member with the toner to form a visible image.

Figure 2:
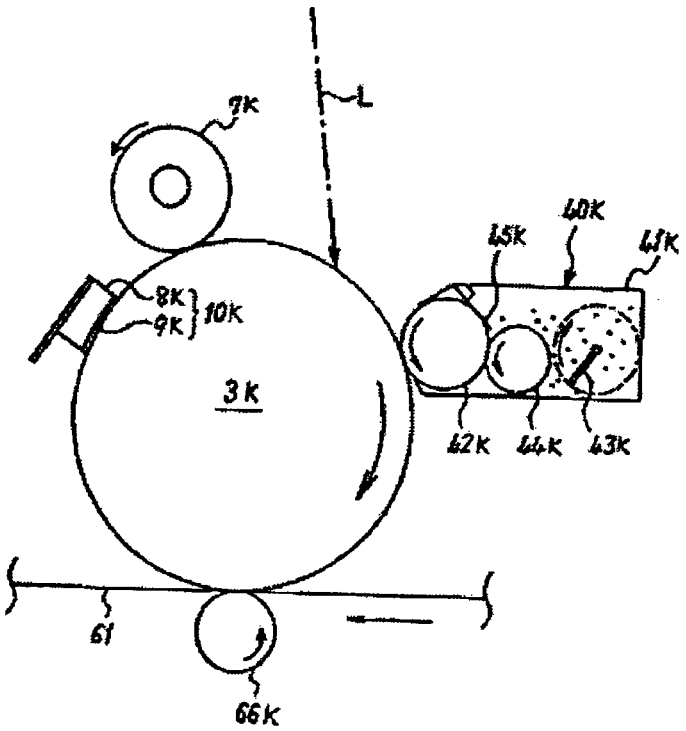
FIG. 2 is a schematic view of one exemplary process cartridge of the present invention.

The toner of the present invention can be used in an image forming apparatus provided with a process cartridge shown, for example, in FIG. 2. The process cartridge shown in FIG. 2 includes a latent electrostatic image bearing member 3K, a latent electrostatic image bearing member charging unit 7K, a charging member 10K configured to recharge toner remaining on the surface of the latent electrostatic image bearing member after the transfer of images from the latent electrostatic image bearing member to a member in the subsequent step, and a developing unit 40K. This process cartridge is mounted detachably to the main body of an image forming apparatus such as a copier or a printer.

In the operation of this process cartridge, the latent electrostatic image bearing member 3K is rotated at a predetermined peripheral speed. In the course of rotating, the latent electrostatic image bearing member 3K receives from the charging unit 7K a uniform, positive or negative electrical charge of a specific potential around its periphery, and then receives image exposure light L from an image exposing unit, such as slit exposure or laser beam scanning exposure, and latent electrostatic images are sequentially formed on the surface of the latent electrostatic image bearing member 3K. Then the formed latent electrostatic images are developed with a toner by the developing unit 40K, and the developed images (toner images) are sequentially transferred by a transfer unit 66K to a transfer target material 61 fed from a paper feed unit (not shown) to the part between the latent electrostatic image bearing member 3K and the transfer unit 66K in synchronization with the rotation of the latent electrostatic image bearing member 3K. The transfer target material 61 to which the images have been transferred is then separated from the surface of the latent electrostatic image bearing member and introduced to an image fixing unit so as to fix the images to the transfer target material 61, and subsequently the transfer target material 61 with the fixed images is printed out as a copy or a print to the outside of the apparatus.

On the surface of the latent electrostatic image bearing member 3K after the image transfer, residual toner which was not transferred is recharged by the charging member 10K that includes an elastic portion 8K and an electrically conductive sheet 9K (formed of an electrically conductive material) and that is configured to recharge toner remaining on the surface of the latent electrostatic image bearing member after the transfer of images from the latent electrostatic image bearing member to a member in a subsequent step. Then the toner is passed through the latent electrostatic image bearing member charging section, recovered in a developing step and repeatedly used for image formation.

The developing unit 40K includes a casing 41K, and a developing roller 42K, the circumferential surface of which is partially exposed from an opening provided in the casing 41K. Regarding the developing roller 42K serving as a developer bearing member, shafts protruding from both ends thereof with respect to the lengthwise direction are supported in a rotatable manner by respective bearings (not shown). The casing 41K houses a K toner, and the K toner is conveyed by a rotationally driven agitator 43K from the right side to the left side in the drawing. At the left side (in the drawing) of the agitator 43K, there is provided a toner supplying roller 44K which is rotationally driven in a counterclockwise direction (in the drawing) by a drive unit (not shown). The roller portion of this toner supplying roller 44K is made of an elastic foamed material such as a sponge and thus favorably receives the K toner sent from the agitator 43K.

The K toner received as just described is then supplied to the developing roller 42K through the contact portion between the toner supplying roller 44K and the developing roller 42K. The K toner borne on the surface of the developing roller 42K serving as a developer bearing member is regulated in terms of its layer thickness and effectively subjected to frictional charging when passing through the position where it comes into contact with a regulating blade 45K, as the developing roller 42K is rotationally driven in the counterclockwise direction (in the drawing). Thereafter, the K toner is conveyed to a developing region that faces the latent electrostatic image bearing member (photoconductor) 3K.

In view of adhesion of the toner, the charging member configured to recharge toner remaining on the surface of the latent electrostatic image bearing member after the transfer of images from the latent electrostatic image bearing member to a member in a subsequent step is preferably electrically conductive because, if the charging member is insulative, the toner will adhere to it due to charge-up.

The charging member is not particularly limited and may be appropriately selected depending on the intended purpose. For example, at least any one of materials selected from nylon, PTFE, PVDF and urethane is preferable. PTFE and PVDF are more preferable in terms of chargeability of the toner.

The charging member preferably has a surface resistance of $10^2$ Ω/sq. to $10^8$ Ω/sq. and a volume resistance of $10^1$ Ω/sq. to $10^6$ Ω/sq.

The charging member is in the form of, for example, a roller, a brush, a sheet, and the like. In view of releasability of the attached toner, the charging member is preferably in the form of a sheet.

In view of charging of the toner, the voltage applied to the charging member is preferably in the range of −1.4 kV to 0 kV.

In the case where the charging member is in the form of an electrically conductive sheet, it is preferred (in view of the contact pressure between the charging member and the latent electrostatic image bearing member) that the thickness of the charging member be in the range of 0.05 mm to 0.5 mm.

Also, in view of the length of time of contact between the charging member and the latent electrostatic image bearing member when the toner is charged, it is preferred that the nip width (where the charging member is in contact with the latent image bearing member) be in the range of 1 mm to 10 mm.

(Image Forming Apparatus and Image Forming Method)

An image forming apparatus of the present invention includes: a latent image bearing member configured to bear a latent image; a charging unit configured to charge a surface of the latent image bearing member uniformly; an exposing unit configured to expose the charged surface of the latent image bearing member, based upon image data, so as to write a latent electrostatic image on the surface of the latent image bearing member; a toner for visualizing the latent image; a developing unit configured to supply the toner to the latent electrostatic image formed on the surface of the latent image bearing member so as to make the latent electrostatic image into a visible image; a transfer unit configured to transfer the visible image on the surface of the latent image bearing member to a transfer target; and a fixing unit configured to fix the visible image on the transfer target. If necessary, the image forming apparatus may further include suitably selected other unit(s) such as a charge eliminating unit, a cleaning unit, a recycling unit, a controlling unit, etc.

An image forming method of the present invention includes the steps of: uniformly charging a surface of a latent image bearing member; exposing the charged surface of the latent image bearing member, based upon image data, so as to write a latent electrostatic image on the surface of the latent image bearing member; forming a developer layer of a predetermined layer thickness over a developer bearing member by means of a developer layer regulating member, developing the latent electrostatic image on the surface of the latent image bearing member with use of the developer layer so as to make the latent electrostatic image into a visible image; transferring the visible image on the surface of the latent image bearing member to a transfer target; and fixing the visible image on the transfer target. Note that the image forming method includes at least latent electrostatic image forming steps, the developing step, the transfer step and the fixing step, and may, if necessary, include suitably selected other step(s) such as a charge eliminating step, a cleaning step, a recycling step, a controlling step, etc.

The latent electrostatic image can be formed, for example, by uniformly charging the surface of the latent image bearing member by means of the charging unit and then exposing the surface imagewise by means of the exposing unit.

The formation of the visible image by the developing may specifically be as follows: a toner layer is formed on a developing roller serving as the developer bearing member, the toner layer on the developing roller is conveyed so as to come into contact with a photoconductor drum serving as the latent image bearing member, a latent electrostatic image on the photoconductor drum is thereby developed, and a visible image is thus formed.

The toner is agitated by an agitating unit and mechanically supplied to a developer supplying member.

The toner supplied from the developer supplying member and then deposited on the developer bearing member is formed into a uniform thin layer and charged, by passing through the developer layer regulating member provided in such a manner as to touch the surface of the developer bearing member.

The latent electrostatic image formed on the latent image bearing member is developed in a developing region by attachment of the charged toner thereto by means of the developing unit, and a toner image is thus formed.

For example, the visible image on the latent image bearing member (photoconductor) can be transferred by charging the latent image bearing member with the use of a transfer charger and can be transferred by the transfer unit.

The visible image transferred to a recording medium is fixed thereto using a fixing unit. Toners of each color may be separately fixed upon their transfer to the recording medium. Alternatively, the toners of each color may be fixed at one time, being in a laminated state.

The fixing unit is not particularly limited and may be appropriately selected depending on the intended purpose. Preference is given to a known heating and pressurizing unit.

Examples of the heating and pressurizing unit include a combination of a heating roller and a pressurizing roller, and a combination of a heating roller, a pressurizing roller and an endless belt.

The temperature at which heating is performed by the heating and pressurizing unit is not particularly limited and may be appropriately selected depending on the intended purpose, but it is preferably in the range of 80° C. to 200° C.

Next, the fundamental structure of an image forming apparatus (printer) according to an embodiment of the present invention will be further explained, referring to drawings.

Figure 3:
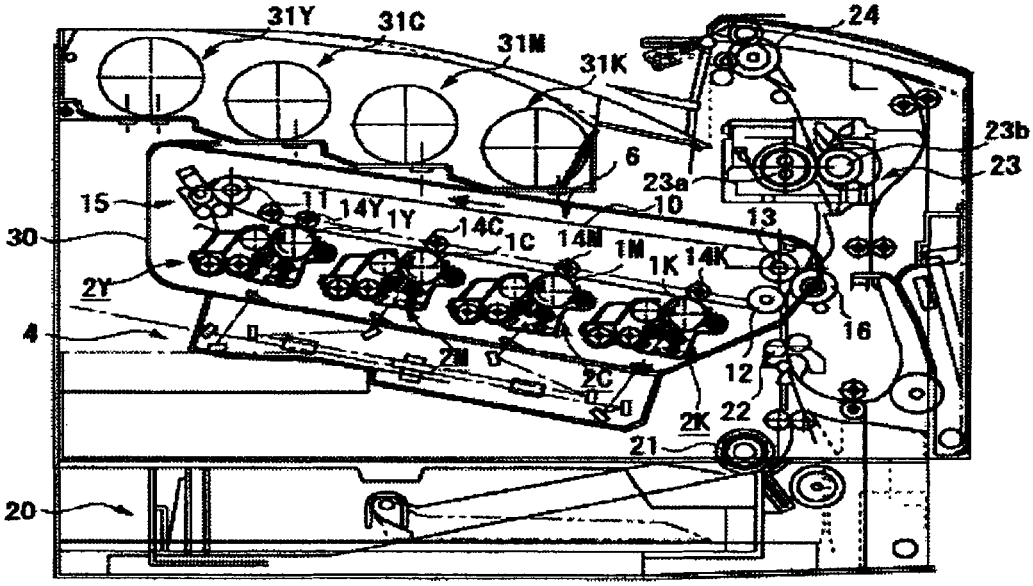
FIG. 3 is a schematic cross-sectional view of one exemplary image forming apparatus of the present invention.

FIG. 3 is a schematic drawing showing the structure of an image forming apparatus according to an embodiment of the present invention.

Here, an embodiment in which the image forming apparatus is used as an electrophotographic image forming apparatus is explained.

The image forming apparatus forms a color image, using toners of four colors, i.e., yellow (hereinafter written as "Y"), cyan (hereinafter written as "C"), magenta (hereinafter written as "M") and black (hereinafter written as "K").

First of all, an explanation is given concerning the fundamental structure of an image forming apparatus (tandem-type image forming apparatus) including a plurality of latent image bearing members, wherein the latent image bearing members are aligned in the moving direction of a surface moving member.

This image forming apparatus includes four photoconductors 1Y, 1C, 1M and 1K as the latent image bearing members. Note that although drum-like photoconductors are employed here as an example, belt-like photoconductors may be employed instead.

The photoconductors 1Y, 1C, 1M and 1K are rotationally driven in the direction of the arrows in the drawing, coming into contact with an intermediate transfer belt 10 that serves as the surface moving member.

The photoconductors 1Y, 1C, 1M and 1K are each produced by forming a photosensitive layer over a relatively thin, cylindrical electrically conductive substrate, and further, forming a protective layer over the photosensitive layer. Additionally, an intermediate layer may be provided between the photosensitive layer and the protective layer.

Figure 4:
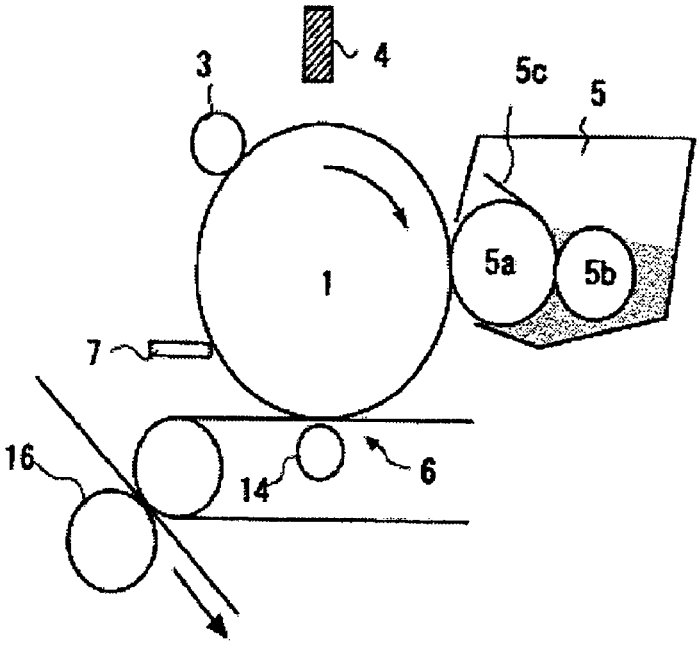
FIG. 4 is a schematic cross-sectional view of one exemplary image forming section in which a photoconductor is disposed.

FIG. 4 is a schematic drawing showing the structure of an image forming unit 2 in which a photoconductor is placed.

In FIG. 4, only one image forming unit 2 is shown and the symbols Y, C, M and K for referring to differences in color are omitted, on the grounds that the structures of the photoconductors 1Y, 1C, 1M and 1K and their surroundings in image forming units 2Y, 2C, 2M and 2K respectively are identical.

Around the photoconductor 1, the following members are disposed in the order mentioned, with respect to the direction in which the surface of the photoconductor 1 moves: a charging device 3 as the charging unit, a developing device 5 as the developing unit, a transfer device 6 as the transfer unit configured to transfer a toner image on the photoconductor 1 to a recording medium or the intermediate transfer belt 10, and a cleaning device 7 configured to remove untransferred toner on the photoconductor 1.

Between the charging device 3 and the developing device 5, there is a space created such that light emitted from an exposing device 4 (which serves as the exposing unit configured to expose the charged surface of the photoconductor 1, based upon image data, so as to write a latent electrostatic image on the surface of the photoconductor 1) can pass through and reach as far as the photoconductor 1.

The charging device 3 charges the surface of the photoconductor 1 such that the surface has negative polarity.

The charging device 3 in the present embodiment includes a charging roller serving as a charging member which performs charging in accordance with a contact or close-distance charging method.

Specifically, this charging device 3 charges the surface of the photoconductor 1 by placing the charging roller so as to be in contact with or close to the surface of the photoconductor 1, and applying a bias of negative polarity to the charging roller.

Such a direct-current charging bias as makes the photoconductor 1 have a surface potential of −500 V is applied to the charging roller.

Additionally, a charging bias produced by superimposing an alternating-current bias onto a direct-current bias may be used as well.

The charging device 3 may be provided with a cleaning brush for cleaning the surface of the charging roller.

Also regarding the charging device 3, a thin film may be wound around both ends (with respect to the axial direction) on the circumferential surface of the charging roller, and this film may be placed so as to touch the surface of the photoconductor 1.

In this structure, the surface of the charging roller and the surface of the photoconductor 1 are very close to each other, with the distance between them being equivalent to the thickness of the film. Thus, electric discharge is generated between the surface of the charging roller and the surface of the photoconductor 1 by the charging bias applied to the charging roller, and the surface of the photoconductor 1 is charged by means of the electric discharge.

The surface of the photoconductor 1 thus charged is exposed by the exposing device 4, and a latent electrostatic image corresponding to each color is formed on the surface of the photoconductor 1.

This exposing device 4 writes a latent electrostatic image (which corresponds to each color) on the surface of the photoconductor 1 based upon image information (which corresponds to each color).

Note that although the exposing device 4 in the present embodiment is of laser type, an exposing device of other type, which includes an LED array and an image forming unit, may be employed as well.

Each toner supplied from toner bottles 31Y, 31C, 31M and 31K into the developing device 5 is conveyed by a developer supplying roller 5*b* and then borne on a developing roller 5*a*.

This developing roller 5*a* is conveyed to a region that faces the photoconductor 1 (hereinafter, this region will be referred to as "developing region").

In the developing region, the surface of the developing roller 5*a* moves in the same direction as and at a higher linear velocity than the surface of the photoconductor 1.

Then, the toner on the developing roller 5*a* is supplied onto the surface of the photoconductor 1, rubbing against the surface of the photoconductor 1. At this time, a developing bias of −300 V is applied from a power source (not shown) to the developing roller 5*a*, and thus a developing electric field is formed in the developing region.

Between the latent electrostatic image on the photoconductor 1 and the developing roller 5*a*, electrostatic force which advances toward the latent electrostatic image acts on the toner borne on the developing roller 5*a*.

Thus, the toner on the developing roller 5*a* is attached to the latent electrostatic image on the photoconductor 1. By this attachment, the latent electrostatic image on the photoconductor 1 is developed into a toner image corresponding to each color.

The intermediate transfer belt 10 in the transfer device 6 is set in a stretched manner on three supporting rollers 11, 12 and 13 and is configured to move endlessly in the direction of the arrow in the drawing.

The toner images on the photoconductors 1Y, 1C, 1M and 1K are transferred by an electrostatic transfer method onto this intermediate transfer belt 10 such that the toner images are superimposed on one another.

The electrostatic transfer method may employ a structure with a transfer charger. Nevertheless, in this embodiment, a structure with a primary transfer roller 14, which causes less scattering of transferred toner, is employed.

Specifically, primary transfer rollers 14Y, 14C, 14M and 14K each serving as a component of the transfer device 6 are placed on the opposite side to the part of the intermediate transfer belt 10 which comes into contact with the photoconductors 1Y, 1C, 1M and 1K.

Here, the part of the intermediate transfer belt 10 pressed by the primary transfer rollers 14Y, 14C, 14M and 14K, and the photoconductors 1Y, 1C, 1M and 1K constitute respective primary transfer nip portions.

When the toner images on the photoconductors 1Y, 1C, 1M and 1K are transferred onto the intermediate transfer belt 10, a bias of positive polarity is applied to each primary transfer roller 14.

Accordingly, a transfer electric field is formed at each primary transfer nip portion, and the toner images on the photoconductors 1Y, 1C, 1M and 1K are electrostatically attached onto the intermediate transfer belt 10 and thus transferred.

A belt cleaning device 15 for removing toner which remains on the surface of the intermediate transfer belt 10 is provided in the vicinity of the intermediate transfer belt 10.

Using a fur brush or a cleaning blade, this belt cleaning device 15 is configured to collect unnecessary toner attached to the surface of the intermediate transfer belt 10.

Parenthetically, the collected unnecessary toner is conveyed from inside the belt cleaning device 15 to a waste toner tank (not shown) by a conveyance unit (not shown).

At the part where the intermediate transfer belt 10 is set in a stretched manner on the supporting roller 13, a secondary transfer roller 16 is placed so as to be in contact with the intermediate transfer belt 10.

A secondary transfer nip portion is formed between the intermediate transfer belt 10 and the secondary transfer roller 16, and transfer paper as a recording medium is sent to this secondary transfer nip portion with predetermined timing.

This transfer paper is stored in a paper feed cassette 20 situated below (in the drawing) the exposing device 4, then the transfer paper is transferred to the secondary transfer nip portion by a paper feed roller 21, a pair of registration rollers 22 and the like.

At the secondary transfer nip portion, the toner images superimposed onto one another on the intermediate transfer belt 10 are transferred onto the transfer paper at one time.

At the time of this secondary transfer, a bias of positive polarity is applied to the secondary transfer roller 16, and the toner images on the intermediate transfer belt 10 are transferred onto the transfer paper by means of a transfer electric field formed by the application of the bias.

A heat fixing device 23 serving as the fixing unit is placed downstream of the secondary transfer nip portion with respect to the direction in which the transfer paper is conveyed.

This heat fixing device 23 includes a heating roller 23*a* with a heater incorporated therein, and a pressurizing roller 23*b* for applying pressure.

The transfer paper which has passed through the secondary transfer nip portion receives heat and pressure, sandwiched between these rollers. This causes the toners on the transfer paper to melt, and a toner image is fixed to the transfer paper. The transfer paper to which the toner image has been fixed is discharged by a paper discharge roller 24 onto a paper discharge tray situated on an upper surface of the apparatus.

Regarding the developing device 5, the developing roller 5*a* serving as the developer bearing member is partially exposed from an opening of a casing of the developing device 5.

Also, in this embodiment, a one-component developer including no carrier is used.

The developing device 5 receives the toner (which corresponds to each color) supplied from the toner bottles 31Y, 31C, 31M and 31K (shown in FIG. 3) and stores it therein.

These toner bottles 31Y, 31C, 31M and 31K are detachably mounted to the main body of the image forming apparatus such that they can be separately replaced.

Due to such a structure, when any of the toners has run out, the corresponding toner bottle among the toner bottles 31Y, 31C, 31M and 31K can be replaced independently. Therefore, when any of the toners has run out, components other than the corresponding toner bottle, whose lifetimes have not yet ended, can continue being used, and thus the user can save costs.

Figure 5:
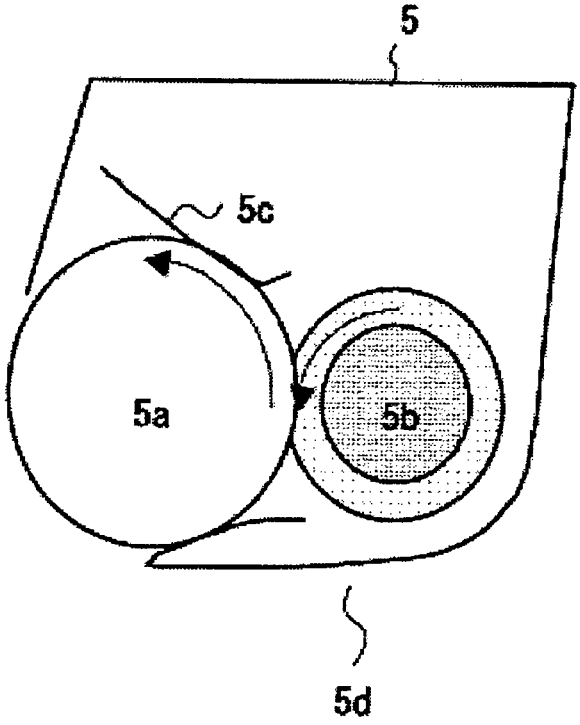
FIG. 5 is a schematic cross-sectional view of one exemplary developing unit.

FIG. 5 is a schematic drawing showing the structure of the developing device 5 shown in FIG. 4.

The developer (toner) housed in a developer storing container is conveyed to a nip portion formed between the developing roller 5*a* (which serves as the developer bearing member configured to bear on its surface the developer to be supplied to the photoconductor 1) and the developer supplying roller 5*b* (which serves as the developer supplying member) while being agitated by the developer supplying roller 5*b*. At this time, the developer supplying roller 5*b* and the developing roller 5*a* rotate in opposite directions to each other (counter rotation) at the nip portion.

The amount of the toner on the developing roller 5*a* is regulated by a regulating blade 5*c* (which serves as the developer layer regulating member) provided so as to touch the developing roller 5*a*, and a toner thin layer is thus formed on the developing roller 5*a*.

Also, the toner is rubbed at the nip portion between the developer supplying roller 5*b* and the developing roller 5*a* and at the part between the regulating blade 5*c* and the developing roller 5*a*, and controlled so as to have an appropriate charge amount.

Figure 6:
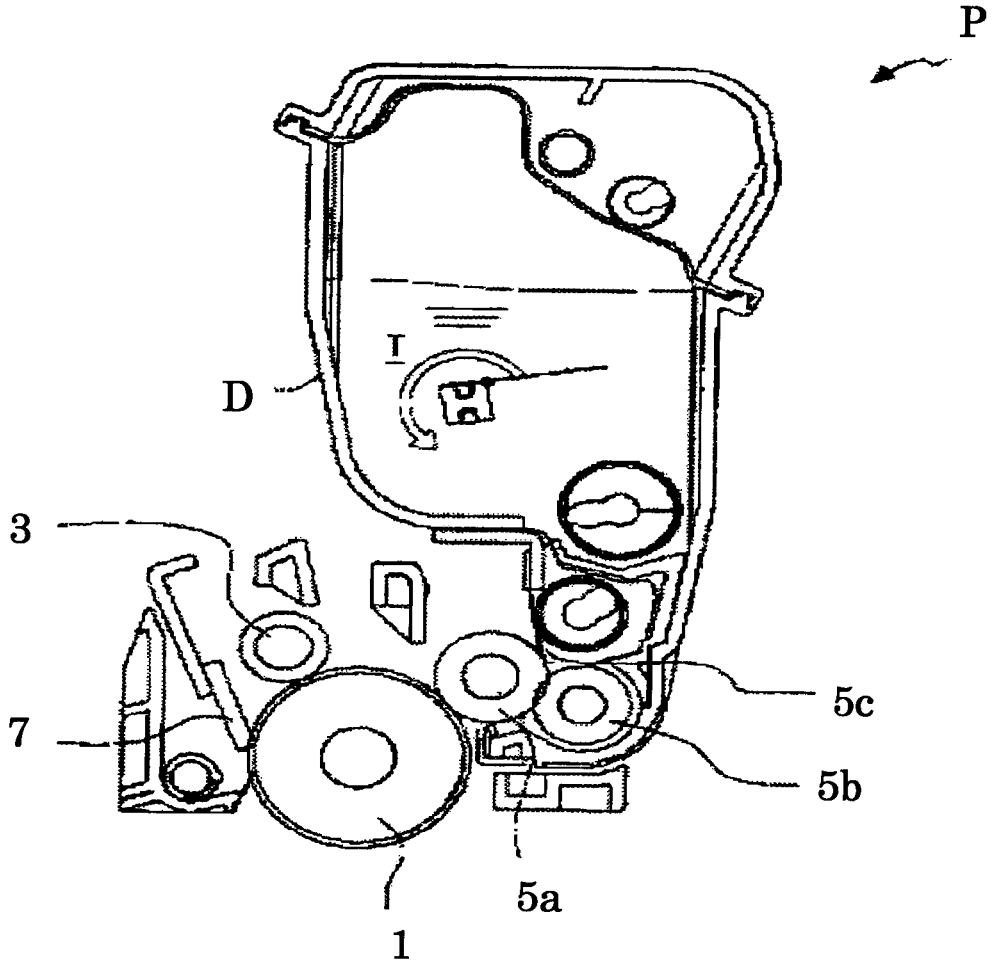
FIG. 6 is a schematic cross-sectional view of one exemplary process cartridge, where "P" denotes a process cartridge and "D" denotes a developer container.

FIG. 6 is a schematic drawing showing the structure of a process cartridge.

The toner according to the present invention can be used, for example, in an image forming apparatus provided with a process cartridge shown in FIG. 6.

In the present invention, among components such as a latent electrostatic image bearing member, a latent electrostatic image charging unit and a developing unit, a plurality of members constitute a single unit as a process cartridge, and this process cartridge is constructed in such a manner as to be detachably mountable to the main body of an image forming apparatus such as a copier or printer.

The process cartridge shown in FIG. 6 includes a latent electrostatic image bearing member, a latent electrostatic image charging unit, and the developing unit explained in relation to FIG. 5.

EXAMPLES

The present invention will next be described by way of Examples, which should not be construed as limiting the present invention thereto. In the following Examples, the unit "part(s)" is part(s) by mass and the unit "%" is % by mass.

<Preparation Method of Resin Dispersion Liquid 1>

A reaction container equipped with a condenser, a stirrer and a nitrogen-introducing pipe was charged with sodium dodecyl sulfate (0.7 parts) and ion-exchange water (498 parts), followed by heating to 80° C. under stirring for dissolution. Then, a solution of potassium persulfate (2.6 parts) in ion-exchange water (104 parts) was added to the resultant solution. Fifteen minutes after the addition, a monomer mixture of a styrene monomer (200 parts) and n-octanethiol (4.2 parts) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 1] having a volume average particle diameter of 135 nm. Subsequently, 2 mL of the thus-obtained [resin dispersion liquid 1] was added to a Petri dish, where the dispersion medium was evaporated. The obtained dry product was measured for number average molecular weight, weight average molecular weight and Tg, which were found to be 8,300, 16,900 and 83° C., respectively.

<Preparation of Resin Dispersion Liquid 2>

A reaction container equipped with a condenser, a stirrer and a nitrogen-introducing pipe was charged with sodium dodecyl sulfate (1.1 parts) and ion-exchange water (498 parts), followed by heating to 80° C. under stirring for dissolution. Then, a solution of potassium persulfate (2.6 parts) in ion-exchange water (104 parts) was added to the resultant solution. Fifteen minutes after the addition, a monomer mixture of a styrene monomer (200 parts) and n-octanethiol (4.2 parts) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 2] having a volume average particle diameter of 93 nm. Subsequently, 2 mL of the thus-obtained [resin dispersion liquid 2] was added to a Petri dish, where the dispersion medium was evaporated. The obtained dry product was measured for number average molecular weight, weight average molecular weight and Tg, which were found to be 8,100, 16,100 and 81° C., respectively.

<Preparation of Resin Dispersion Liquid 3>

A reaction container equipped with a condenser, a stirrer and a nitrogen-introducing pipe was charged with sodium dodecyl sulfate (0.7 parts) and ion-exchange water (498 parts), followed by heating to 80° C. under stirring for dissolution. Then, a solution of potassium persulfate (2.5 parts) in ion-exchange water (101 parts) was added to the resultant solution. Fifteen minutes after the addition, a monomer mixture of a styrene monomer (169 parts), butyl acrylate (30 parts) and divinyl benzene (1 part) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 3] having a volume average particle diameter of 100 nm. Subsequently, 2 mL of the thus-obtained [resin dispersion liquid 3] was added to a Petri dish, where the dispersion medium was evaporated. The obtained dry product was measured for number average molecular weight, weight average molecular weight and Tg, which were found to be 31,300, 88,300 and 75° C., respectively.

<Preparation of Resin Dispersion Liquid 4>

A reaction container equipped with a condenser, a stirrer and a nitrogen-introducing pipe was charged with sodium dodecyl sulfate (0.7 parts) and ion-exchange water (498 parts), followed by heating to 80° C. under stirring for dissolution. Then, a solution of potassium persulfate (2.5 parts) in ion-exchange water (101 parts) was added to the resultant solution. Fifteen minutes after the addition, a monomer mixture of a styrene monomer (149 parts), diethylene glycol monomethyl methacrylate (50 parts) and divinyl benzene (1 part) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 4] having a volume average particle diameter of 110 nm. Subsequently, 2 mL of the thus-obtained [resin dispersion liquid 4] was added to a Petri dish, where the dispersion medium was evaporated. The obtained dry product was measured for number average molecular weight, weight average molecular weight and Tg, which were found to be 12,000, 42,000 and 52° C., respectively.

<Preparation of Resin Dispersion Liquid 5>

A reaction container equipped with a condenser, a stirrer and a nitrogen-introducing pipe was charged with sodium dodecyl sulfate (1.4 parts) and ion-exchange water (498 parts), followed by heating to 80° C. under stirring for dissolution. Then, a solution of potassium persulfate (2.6 parts) in ion-exchange water (104 parts) was added to the resultant solution. Fifteen minutes after the addition, a monomer mixture of a styrene monomer (200 parts) and n-octanethiol (4.2 parts) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 5] having a volume average particle diameter of 65 nm. Subsequently, 2 mL of the thus-obtained [resin dispersion liquid 5] was added to a Petri dish, where the dispersion medium was evaporated. The obtained dry product was measured for number average molecular weight, weight average molecular weight and Tg, which were found to be 8,500, 17,300 and 82° C., respectively.

[Production Method of Polymerized Toner]

<Synthesis of Polyester 1>

A reaction container equipped with a condenser, a stirrer and a nitrogen-introducing pipe was charged with bisphenol A ethylene oxide 2 mol adduct (229 parts), bisphenol A propylene oxide 3 mol adduct (529 parts), terephthalic acid (208 parts), adipic acid (46 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg. Then, trimellitic anhydride (44 parts) was added to the reaction container, followed by reaction at 180° C. for 2 hours under normal pressure, to thereby synthesize [polyester 1]. The thus-obtained [polyester 1] was found to have a number average molecular weight of 2,500, a weight average molecular weight of 6,700, a glass transition temperature of 43° C. and an acid value of 25 mgKOH/g.

<Synthesis of Polyester 2>

A reaction container equipped with a condenser, a stirrer and a nitrogen-introducing pipe was charged with bisphenol A ethylene oxide 2 mol adduct (264 parts), bisphenol A propylene oxide 2 mol adduct (523 parts), terephthalic acid (123 parts), adipic acid (173 parts) and dibutyl tin oxide (1 part), followed by reaction at 230° C. for 8 hours under normal pressure. Next, the reaction mixture was allowed to react for 8 hours under a reduced pressure of 10 mmHg to 15 mmHg. Then, trimellitic anhydride (26 parts) was added to the reaction container, followed by reaction at 180° C. for 2 hours under normal pressure, to thereby obtain [polyester 2]. [Polyester 2] was found to have a number average molecular weight of 4,000, a weight average molecular weight of 47,000, a Tg of 65° C. and an acid value of 12.

<Synthesis of Polyester 3>

A reaction container equipped with a condenser, a stirrer and a nitrogen-introducing pipe was charged with bisphenol A ethylene oxide 2 mol adduct (270 parts), bisphenol A propylene oxide 2 mol adduct (497 parts), terephthalic acid (110 parts), isophthalic acid (102 parts), adipic acid (44 parts) and dibutyl tin oxide (2 parts), followed by reaction at 230° C. for 9 hours under normal pressure. Next, the reaction mixture was allowed to react for 7 hours under a reduced pressure of 10 mmHg to 18 mmHg. Then, trimellitic anhydride (40 parts) was added to the reaction container, followed by reaction at 180° C. for 2 hours under normal pressure, to thereby obtain [polyester 3]. [Polyester 3] was found to have a number average molecular weight of 3,000, a weight average molecular weight of 8,600, a glass transition temperature of 49° C. and an acid value of 22 mgKOH/g.

<Synthesis of Isocyanate-Modified Polyester 1>

A reaction container equipped with a condenser, a stirrer and a nitrogen-introducing pipe was charged with bisphenol A ethylene oxide 2 mol adduct (682 parts), bisphenol A propylene oxide 2 mol adduct (81 parts), terephthalic acid (283 parts), trimillitic anhydride (22 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg, to thereby synthesize [intermediate polyester 1]. The thus-obtained [intermediate polyester 1] was found to have a number average molecular weight of 2,200, a weight average molecular weight of 9,700, a glass transition temperature of 54° C., an acid value of 0.5 mgKOH/g and a hydroxyl value of 52 mgKOH/g.

Next, a reaction container equipped with a condenser, a stirrer and a nitrogen-introducing pipe was charged with [intermediate polyester 1] (410 parts), isophorone diisocyanate (89 parts) and ethyl acetate (500 parts), followed by reaction at 100° C. for 5 hours, to thereby obtain [isocyanate-modified polyester 1].

<Synthesis of Masterbatch>

Carbon black (40 parts) (REGAL 400R, product of Cabot Corporation), polyester resin (60 parts) (RS-801, product of Sanyo Chemical Industries, Ltd., acid value: 10, Mw: 20,000, Tg: 64° C.) as a binder resin and water (30 parts) were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm, whereby [masterbatch 1] was obtained.

Example 1

Preparation Step of Oil Phase

A container to which a stirring rod and a thermometer had been set was charged with [polyester 1] (545 parts), [paraffin wax (melting point: 74° C.)] (181 parts) and ethyl acetate (1,450 parts). The mixture was increased in temperature to 80° C. under stirring, maintained at 80° C. for 5 hours, and cooled to 30° C. for 1 hour. Then, the container was charged with [masterbatch 1] (500 parts) and ethyl acetate (100 parts), followed by mixing for 1 hour, to thereby obtain [raw material solution 1].

[Raw material solution 1] (1,500 parts) was placed in a container, where the pigment and the wax were dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes. Next, a 66% by mass ethyl acetate solution of [polyester 2] (655 parts) was added thereto, and passed once with the bead mill under the above conditions, to thereby obtain [pigment/wax dispersion liquid 1].

[Pigment/wax dispersion liquid 1] (976 parts) was mixed for 1 min at 5,000 rpm with a TK homomixer (product of Tokushu Kika Kogyo Co., Ltd.). Then, [isocyanate-modified polyester 1] (88 parts) was added to the [pigment/wax dispersion liquid 1]. The resultant mixture was mixed for 1 min at 5,000 rpm with a TK homomixer (product of Tokushu Kika Kogyo Co., Ltd.), to thereby obtain [oil phase 1]. Through measurement, the solid content of [oil phase 1] was found to be 52.0% by mass, and the amount of ethyl acetate in the solid content was found to be 92% by mass.

<Preparation of Aqueous Phase>

Ion-exchange water (970 parts), 40 parts of 25% by mass aqueous dispersion liquid of fine organic resin particles for stabilizing dispersion (a copolymer of styrene-methacrylic acid-butyl acrylate-sodium salt of methacrylic acid ethylene oxide adduct sulfuric acid ester), 95 parts of 48.5% by mass aqueous solution of sodium dodecyl diphenyl ether disulfonate and 98 parts of ethyl acetate were mixed together under stirring. The resultant mixture was found to have a pH of 6.2. Then, 10% by mass aqueous solution of sodium hydroxide was added dropwise thereto to adjust the pH to 9.5, whereby [aqueous phase 1] was obtained.

<Production Step of Core Particles>

The obtained [aqueous phase 1] (1,200 parts) was added to [oil phase 1]. The resultant mixture was mixed for 2 min with a TK homomixer at 8,000 rpm to 15,000 rpm, while being adjusted to 20° C. to 23° C. in a water bath to suppress increase in temperature due to shear heat of the mixer. Thereafter, the mixture was stirred for 10 min at 130 rpm to 350 rpm using a three-one motor equipped with an anchor wing, to thereby obtain [core particle slurry 1] containing liquid droplets of the oil phase (core particles) dispersed in the aqueous phase.

<Formation of Protrusions>

First, [resin dispersion liquid 1] (106 parts) was mixed with ion-exchange water (71 parts). The resultant mixture (solid concentration: 15%) was added dropwise for 3 min to [core particle slurry 1] whose temperature was adjusted to 22° C. This addition was performed while [core particle slurry 1] was being stirred at 130 rpm to 350 rpm with a three-one motor equipped with an anchor wing. Thereafter, the mixture was further stirred for 30 min at 200 rpm to 450 rpm to obtain [composite particle slurry 1]. Then, 1 mL of [composite particle slurry 1] was diluted so as to have a volume of 10 mL, followed by centrifugation, whereby a transparent supernatant was obtained.

<Desolvation>

A container to which a stirrer and a thermometer had been set was charged with [composite particle slurry 1], which was desolvated with stirring at 30° C. for 8 hours to obtain [dispersion slurry 1]. A small amount of [dispersion slurry 1] was placed on a glass slide, and observed through a cover glass under an optical microscope (×200). As a result, uniform colored particles were observed. Also, 1 mL of [dispersion slurry 1] was diluted so as to have a volume of 10 mL, followed by centrifugation, whereby a transparent supernatant was obtained.

<Washing and Drying Step>

[Dispersion slurry 1] (100 parts) was filtrated under reduced pressure and then (1): ion-exchanged water (100 parts) was added to the filtration cake, and the mixture was mixed with TK Homomixer (at 12,000 rpm for 10 minutes), followed by filtration.

(2): ion-exchanged water (900 parts) was added to the filtration cake obtained in (1), and the mixture was mixed by applying ultrasonic wave vibrations by means of TK Homomixer (at 12,000 rpm for 30 minutes) followed by filtration under reduced pressure. This operation was repeated until the electric conductivity of the reslurry became 10 μC/cm or lower.

(3): 10% hydrochloric acid was added to the reslurry obtained in (2) to adjust the pH to 4, and the resultant was stirred by means of a three-one motor for 30 minutes, followed by subjected to filtration.

(4): Ion-exchanged water (100 parts) was added to the filtration cake obtained in (3), and the mixture was mixed by means of TK Homomixer (at 12,000 rpm for 10 minutes), followed by subjected to filtration. This operation was repeated until the electric conductivity of the reslurry became 10 μC/cm or lower, to thereby obtain [filtration cake 1].

[Filtration cake 1] was dried with an air-circulation dryer at 45° C. for 48 hours, and then sieved with a mesh having an opening size of 75 μm to obtain [toner base 1]. Through observation of the obtained [toner base 1] under a scanning electron microscope, the vinyl resin was found to be uniformly attached to the surfaces of the core particles.

[Toner base 1] (100 parts) and the external additives in Table 1 were mixed together using HENSCHEL MIXER. The resultant mixture was allowed to pass through a sieve with an opening size of 60 μm to remove coarse particles and aggregates, whereby [toner 1] was obtained.

Example 2

[Toner 2] was obtained in the same manner as in Example 1, except that [resin dispersion liquid 1] was changed to [resin dispersion liquid 2].

Example 3

[Toner 3] was obtained in the same manner as in Example 1, except that [resin dispersion liquid 1] was changed to [resin dispersion liquid 3].

Example 4

[Toner 4] was obtained in the same manner as in Example 1, except that the [isocyanate-modified polyester 1] was not added.

Example 5

[Toner 5] was obtained in the same manner as in Example 1, except that the amounts of "resin dispersion liquid" and ion-exchange water in the step of <formation of protrusions> were changed to 42 parts of [resin dispersion liquid 1] and 31 parts of ion-exchange water, respectively.

Example 6

[Toner 6] was obtained in the same manner as in Example 1, except that the amounts of "resin dispersion liquid" and ion-exchange water in the step of <formation of protrusions> were changed to 318 parts of [resin dispersion liquid 1] and 231 parts of ion-exchange water, respectively.

Example 7

[Toner base 1] of Example 1 (100 parts) and the external additives in Table 1 were mixed together using HENSCHEL MIXER. The resultant mixture was allowed to pass through a sieve with an opening size of 60 μm to remove coarse particles and aggregates, whereby [toner 7] was obtained.

Example 8

[Toner base 1] of Example 1 (100 parts) and the external additives in Table 1 were mixed together using HENSCHEL MIXER. The resultant mixture was allowed to pass through a sieve with an opening size of 60 μm to remove coarse particles and aggregates, whereby [toner 8] was obtained.

Example 9

[Toner base 1] of Example 1 (100 parts) and the external additives in Table 1 were mixed together using HENSCHEL MIXER. The resultant mixture was allowed to pass through a sieve with an opening size of 60 μm to remove coarse particles and aggregates, whereby [toner 9] was obtained.

Example 10

[Toner base 1] of Example 1 (100 parts) and the external additives in Table 1 were mixed together using HENSCHEL MIXER. The resultant mixture was allowed to pass through a sieve with an opening size of 60 μm to remove coarse particles and aggregates, whereby [toner 10] was obtained.

Comparative Example 1

[Toner 11] was obtained in the same manner as in Example 1, except that [resin dispersion liquid 1] was not added.

Comparative Example 2

[Toner 12] was obtained in the same manner as in Example 1, except that [resin dispersion liquid 1] in the step of <formation of protrusions> was changed to [resin dispersion liquid 4].

Comparative Example 3

[Toner 13] was obtained in the same manner as in Example 1, except that [resin dispersion liquid 1] in the step of <formation of protrusions> was changed to [resin dispersion liquid 5].

Comparative Example 4

[Toner 14] was obtained in the same manner as in Example 1, except that [resin dispersion liquid 1] (106 parts) and ion-exchange water (71 parts) in the step of <formation of protrusions> were changed to [resin dispersion liquid 1] (53 parts), [resin dispersion liquid 5] (53 parts) and ion-exchange water (71 parts).

Comparative Example 5

[Toner 15] was obtained in the same manner as in Example 1, except that the amount of [resin dispersion liquid 1] was changed from 106 parts to 530 parts, and that 105 parts of 48.5% aqueous solution of sodium dodecyl diphenyl ether disulfonate was added simultaneously with the addition of [resin dispersion liquid 1] in the step of <formation of protrusions>.

Comparative Example 6

[Toner 16] was obtained in the same manner as in Example 1, except that [resin dispersion liquid 1] (106 parts) and ion-exchange water (71 parts) in the step of <formation of protrusions> were changed to [resin dispersion liquid 1] (10 parts) and ion-exchange water (7 parts).

Comparative Example 7

[Toner 17] was obtained in the same manner as in Example 1, except that [resin dispersion liquid 1] (106 parts) and ion-exchange water (71 parts) in the step of <formation of protrusions> were changed to [resin dispersion liquid 1] (530 parts) and ion-exchange water (385 parts).

Comparative Example 8

[Toner base 1] of Example 1 (100 parts) and the external additives in Table 1 were mixed together using HENSCHEL MIXER. The resultant mixture was allowed to pass through a sieve with an opening size of 60 μm to remove coarse particles and aggregates, whereby [toner 18] was obtained.

Note that external additives in Table 1 represent the following:

RX200: product of Nippon Aerosil Co., Ltd.

primary particle diameter: 12 nm without treatment with an amino group-containing silane coupling agent NA50H: product of Nippon Aerosil Co., Ltd.

primary particle diameter: 30 nm with treatment with an amino group-containing silane coupling agent MSP-009: product of Tayca Corporation primary particle diameter: 80 nm with treatment with an amino group-containing silane coupling agent.

(Evaluation)

The above-obtained toners were evaluated by the below-described methods.

<Background Smear>

After printing of 2,000 sheets having a chart with an image area ratio of 1% using a color electrophotographic apparatus (IPSIO SP C220), a piece of Scotch tape was used to remove the toner attached on the photoconductor having been subjected to printing of white solid images, and the piece of tape was attached to blank paper. Then, the ΔE was measured with a spectrodensitometer (product of X-Rite, Incorporated) and evaluated on the basis of the following 4 ranks.

[Evaluation Criteria]

A: $\Delta E<3$

B: $3\leq\Delta E<5$

C: $5\leq\Delta E<10$

D: $10\leq\Delta E$

<Adhesion Resistance>

After printing of 2,000 sheets having a chart with an image area ratio of 1% using a color electrophotographic apparatus (IPSIO SP C220), a black solid image was printed. The black solid image (7.8 cm×1.0 cm) was evaluated for adhesion resistance on the basis of the following 4 ranks by comparing it with the references for each rank.

[Evaluation Criteria]

A: No white streaks were observed; very good level

B: No noticeable white streaks were observed and white streaks found give no adverse effects to image quality C: White streaks were observed, giving adverse effects to image quality D: White streaks were observed, giving considerable adverse effects to image quality <Change of Image Density>

Before and after printing of 2,000 sheets having a chart with an image area ratio of 1% using a color electrophotographic apparatus (IPSIO SP C220), a black solid image was printed on paper (TYPE 6000, product of Ricoh Company, Ltd.). Then, the image density was measured with a spectrodensitometer (product of X-Rite, Incorporated) and evaluated for a change in image density; i.e., the difference in reflectance measured by the above spectrodensitometer between before and after printing of 2,000 sheets (reflectance before printing of 2,000 sheets—reflectance after printing of 2,000 sheets).

[Evaluation Criteria]

A: Difference<0.1%

B: 0.1%≤Difference<0.2%

C: 0.2%≤Difference<0.3%

D: 0.3%≤Difference

<Fixability>

The toner was placed in the remodeled IPSIO SP C220, and the copier was set so that the amount of the toner added onto My Recycle Paper, 100 T-Type paper, produced by Ricoh Company Ltd. was 11 g/m$^2$, and 19 sheets of 50 mm square unfixed solid print image were prepared.

Next, using the remodeled fixing unit, the system speed was set to 180 mm/sec, the unfixed solid image prepared as above was passed to fix the image on paper. The fixing test was performed while varying the fixing temperature from 120° C. to 200° C. in increments of 10° C. The paper was folded with the fixed images inside and the paper was unfolded. Then, the paper was rubbed lightly with an eraser. A minimum temperature at which a fold line was not erased was regarded as a minimum fixing temperature.

[Evaluation Criteria]

A: Minimum fixing temperature<130° C.

B: 130° C.≤Minimum fixing temperature<140° C.

C: 140° C.≤Minimum fixing temperature<150° C.

D: 150° C.≤Minimum fixing temperature

<Charging Roller Smear>

After printing of 2,000 sheets having a chart with an image area ratio of 1% using a color electrophotographic apparatus (IPSIO SP C220), a surface of the charging roller was visually evaluated for smear on the basis of the following 4 ranks.

A: No roller smear was observed, very good

B: Roller smear was observed but non-problematic in practical use

C: Roller smear was observed and problematic in practical use

D: Noticeable roller smear was observed

<Photoconductor Abrasion>

After printing of 2,000 sheets having a chart with an image area ratio of 1% using a color electrophotographic apparatus (IPSIO SP C220), a surface of the photoconductor was visually evaluated for abrasion on the basis of the following 4 ranks.

A: No streaky abrasion was observed, very good

B: Streaky abrasion was observed but non-problematic in practical use

C: Streaky abrasion was observed and problematic in practical use

D: Noticeable streaky abrasion was observed

TABLE 1

| | | Toner base | | | | | | External additives | | |
|---|---|---|---|---|---|---|---|---|---|---|
| | | | | | Protrusions | | | | | |
| | Toner | Average particle diameter (μm) | Dv/Dn | Sphericity | Long side length (μm) | Standard deviation | Coverage rate (%) | RX200 (Parts) | NA50H (Parts) | MSP-009 (Parts) |
| Ex. 1 | Toner 1 | 6.5 | 1.12 | 0.985 | 0.23 | 0.10 | 56 | 1.5 | 0 | 0.4 |
| Ex. 2 | Toner 2 | 6.4 | 1.14 | 0.986 | 0.21 | 0.09 | 51 | 1.5 | 0 | 0.4 |
| Ex. 3 | Toner 3 | 6.5 | 1.15 | 0.986 | 0.24 | 0.09 | 54 | 1.5 | 0 | 0.4 |
| Ex. 4 | Toner 4 | 8.1 | 1.12 | 0.986 | 0.34 | 0.12 | 36 | 1.5 | 0 | 0.4 |
| Ex. 5 | Toner 5 | 6.2 | 1.16 | 0.985 | 0.18 | 0.06 | 18 | 1.5 | 0 | 0.4 |
| Ex. 6 | Toner 6 | 7.1 | 1.18 | 0.978 | 0.39 | 0.18 | 72 | 1.5 | 0 | 0.4 |
| Ex. 7 | Toner 7 | 6.5 | 1.12 | 0.985 | 0.23 | 0.10 | 56 | 1.5 | 0 | 0.6 |
| Ex. 8 | Toner 8 | 6.5 | 1.12 | 0.985 | 0.23 | 0.10 | 56 | 1.5 | 0 | 0.1 |
| Ex. 9 | Toner 9 | 6.5 | 1.12 | 0.985 | 0.23 | 0.10 | 56 | 1.5 | 0.4 | 0 |
| Ex. 10 | Toner 10 | 6.5 | 1.12 | 0.985 | 0.23 | 0.10 | 56 | 1.5 | 0.6 | 0 |
| Com. Ex. 1 | Toner 11 | 5.9 | 1.16 | 0.986 | — | — | 0 | 1.5 | 0 | 0.4 |
| Com. Ex. 2 | Toner 12 | 6.8 | 1.13 | 0.972 | 0.52 | 0.18 | 68 | 1.5 | 0 | 0.4 |
| Com. Ex. 3 | Toner 13 | 6.1 | 1.18 | 0.988 | 0.09 | 0.07 | 42 | 1.5 | 0 | 0.4 |
| Com. Ex. 4 | Toner 14 | 6.4 | 1.13 | 0.986 | 0.2 | 0.26 | 51 | 1.5 | 0 | 0.4 |
| Com. Ex. 5 | Toner 15 | 4.9 | 1.22 | 0.950 | 0.41 | 0.22 | 98 | 1.5 | 0 | 0.4 |
| Com. Ex. 6 | Toner 16 | 5.1 | 1.18 | 0.986 | 0.25 | 0.12 | 8 | 1.5 | 0 | 0.4 |
| Com. Ex. 7 | Toner 17 | 8.5 | 1.27 | 0.935 | 0.48 | 0.33 | 88 | 1.5 | 0 | 0.4 |
| Com. Ex. 8 | Toner 18 | 6.5 | 1.12 | 0.985 | 0.23 | 0.10 | 56 | 1.5 | 0 | 0 |

TABLE 2

| | Background smear | Adhesion resistance | Change of image density | Minimum fixing temperature | Charging roller smear | Photoconductor abrasion |
|---|---|---|---|---|---|---|
| Ex. 1 | A | B | A | A | A | A |
| Ex. 2 | A | B | A | A | A | A |
| Ex. 3 | A | B | A | A | A | A |
| Ex. 4 | A | B | A | A | A | A |
| Ex. 5 | B | B | A | A | A | A |
| Ex. 6 | A | A | A | A | A | A |
| Ex. 7 | A | A | A | A | A | B |
| Ex. 8 | A | A | A | A | A | B |
| Ex. 9 | B | A | A | A | A | A |
| Ex. 10 | B | A | A | A | A | A |
| Com. Ex. 1 | D | D | D | A | A | A |
| Com. Ex. 2 | A | B | B | C | D | D |
| Com. Ex. 3 | D | D | C | A | A | A |
| Com. Ex. 4 | A | A | D | C | D | C |
| Com. Ex. 5 | B | A | B | D | D | C |
| Com. Ex. 6 | D | D | D | A | A | A |
| Com. Ex. 7 | A | A | D | D | D | D |
| Com. Ex. 8 | D | B | C | A | A | A |

The embodiments of the present invention are as follows.

<1> A Toner including:

toner particles each including a toner base particle and an external additive attached thereon, where the toner base particle includes a binder resin and a colorant, wherein the toner base particle has protrusions on a surface thereof, wherein an average of lengths of long sides of the protrusions is 0.10 μm or more but less than 0.50 μm, wherein a standard deviation of the lengths of the long sides of the protrusions is 0.2 or less, wherein a coverage rate of the protrusions on the surface of the toner base particle is 10% to 90%, and wherein the external additive includes fine inorganic particles whose surfaces have been treated with an amino group-containing silane coupling agent.

<2> The toner according to <1>, wherein primary particles of the fine inorganic particles have an average particle diameter of 100 nm or less.

<3> The toner according to <1> or <2>, wherein an amount of the fine inorganic particles in the toner is 0.1% by mass to 2.0% by mass.

<4> The toner according to any one of <1> to <3>, wherein an amount of the fine inorganic particles in the external additive is 5% by mass to 30% by mass.

<5> The toner according to any one of <1> to <4>, wherein the protrusions are made of a resin, and the resin is obtained by polymerizing a monomer mixture containing styrene.

<6> The toner according to <5>, wherein an amount of the resin of which the protrusions are made is 1% by mass to 20% by mass in the toner.

<7> The toner according to any one of <1> to <6>, wherein the toner has a rate of 1.25 or less where the rate is a rate of a volume average particle diameter to a number average particle diameter of the toner.

<8> The toner according to any one of <1> to <7>, wherein the toner has an average sphericity of 0.930 or more.

<9> The toner according to any one of <1> to <8>, wherein the toner base particles are obtained by a method including:

producing toner core particles; and fusing and attaching the protrusions onto surfaces of the toner core particles.

<10> An image forming apparatus including:

a latent image bearing member which bears a latent image thereon;

a charging unit configured to uniformly charge a surface of the latent image bearing member;

an exposing unit configured to expose the charged surface of the latent image bearing member to light based on image data to form a latent electrostatic image;

a toner which visualizes the latent electrostatic image;

a developing unit configured to supply the toner to develop the latent electrostatic image formed on the surface of the latent image bearing member, to thereby form a visible image on the surface of the latent image bearing member;

a transfer unit configured to transfer, onto an image-receiving medium, the visible image formed on the surface of the latent image bearing member; and a fixing unit configured to fix the transferred visible image on the image-receiving medium, wherein the toner is the toner according to any one of <1> to <9>.

<11> A process cartridge including:

a latent image bearing member, a developing unit configured to develop, with a toner, a latent electrostatic image formed on a surface of the latent image bearing member to form a visible image, the latent image bearing member and the developing unit being integrally supported in the process cartridge which is mounted detachably to an image forming apparatus, wherein the toner is the toner according to any one of <1> to <9>.

REFERENCE SIGNS LIST

1, 1Y, 1C, 1M, 1K photoconductor
2, 2Y, 2C, 2M, 2K image forming section
3 charging device
3K latent electrostatic image bearing member
4 exposing device
5 developing device
5*a* developing roller
5*b* developer supplying roller
6 transfer device
7 cleaning device
7K charging unit
8K elastic portion
9K electrically conductive sheet
10K charging member
10 intermediate transfer belt
11, 12, 13 supporting roller
14, 14Y, 14C, 14M, 14K primary transfer roller
15 belt cleaning device
16 secondary transfer roller
20 paper feed cassette
21 paper feed roller
22 a pair of registration rollers
23 heat fixing device
23*a* heating roller
23*b* pressurizing roller
24 paper discharge roller
31Y, 31C, 31M, 31K toner bottle
40K developing unit
41K casing
42K developing roller
43K agitator
44K toner supplying roller
45K regulating blade
66K transfer unit
61 transfer target material

The invention claimed is:

1. A toner comprising:

toner particles each comprising a toner base particle and an external additive attached thereon, wherein the toner base particle comprises a binder resin and a colorant, the toner base particle has protrusions on a surface thereof, an average of lengths of long sides of the protrusions is 0.10 μm or more but less than 0.50 μm, a standard deviation of the lengths of the long sides of the protrusions is 0.2 or less, a coverage rate of the protrusions on the surface of the toner base particle is from 10% to 90%, and the external additive comprises fine inorganic particles whose surfaces have been treated with a silane coupling agent comprising an amino group.

2. The toner according to claim 1, wherein primary particles of the fine inorganic particles have an average particle diameter of 100 nm or less.

3. The toner according to claim 1, wherein an amount of the fine inorganic particles in the toner is from 0.1% by mass to 2.0% by mass.

4. The toner according to claim 1, wherein an amount of the fine inorganic particles in the external additive is from 5% by mass to 30% by mass.

5. The toner according to claim 1, wherein the protrusions comprise a resin, and the resin is obtained by polymerizing a monomer mixture comprising styrene.

6. The toner according to claim 5, wherein an amount of the resin is from 1% by mass to 20% by mass in the toner.

7. The toner according to claim 1, wherein the toner has a rate of 1.25 or less, in which the rate is a rate of a volume average particle diameter to a number average particle diameter of the toner.

8. The toner according to claim 1, wherein the toner has an average sphericity of 0.930 or more.

9. The toner according to claim 1, wherein the toner base particles are obtained by a method comprising:

producing toner core particles; and fusing and attaching the protrusions onto surfaces of the toner core particles.

10. An image forming apparatus comprising:

a latent image bearing member which bears a latent image thereon;

a charging unit configured to uniformly charge a surface of the latent image bearing member;

an exposing unit configured to expose the charged surface of the latent image bearing member to light based on image data to form a latent electrostatic image;

a toner which visualizes the latent electrostatic image;

a developing unit configured to supply the toner to develop the latent electrostatic image formed on the surface of the latent image bearing member, to thereby form a visible image on the surface of the latent image bearing member;

a transfer unit configured to transfer, onto an image-receiving medium, the visible image formed on the surface of the latent image bearing member; and a fixing unit configured to fix the transferred visible image on the image-receiving medium, wherein the toner comprises:

toner particles each comprising a toner base particle and an external additive attached thereon, wherein the toner base particle comprises a binder resin and a colorant, the toner base particle has protrusions on a surface thereof, an average of lengths of long sides of the protrusions is 0.10 μm or more but less than 0.50 μm, a standard deviation of the lengths of the long sides of the protrusions is 0.2 or less, a coverage rate of the protrusions on the surface of the toner base particle is from 10% to 90%, and the external additive comprises fine inorganic particles whose surfaces have been treated with a silane coupling agent comprising an amino group.

11. A process cartridge comprising:

a latent image bearing member, a developing unit configured to develop, with a toner, a latent electrostatic image formed on a surface of the latent image bearing member to form a visible image, the latent image bearing member and the developing unit being integrally supported in the process cartridge which is mounted detachably to an image forming apparatus, wherein the toner comprises:

toner particles each comprising a toner base particle and an external additive attached thereon, wherein the toner base particle comprises a binder resin and a colorant, the toner base particle has protrusions on a surface thereof, an average of lengths of long sides of the protrusions is 0.10 μm or more but less than 0.50 μm, a standard deviation of the lengths of the long sides of the protrusions is 0.2 or less, a coverage rate of the protrusions on the surface of the toner base particle is from 10% to 90%, and the external additive comprises fine inorganic particles whose surfaces have been treated with a silane coupling agent comprising an amino group.

12. The apparatus according to claim 10, wherein primary particles of the fine inorganic particles have an average particle diameter of 100 nm or less.

13. The apparatus according to claim 10, wherein an amount of the fine inorganic particles in the toner is from 0.1% by mass to 2.0% by mass.

14. The apparatus according to claim 10, wherein an amount of the fine inorganic particles in the external additive is from 5% by mass to 30% by mass.

15. The apparatus according to claim 10, wherein the protrusions comprise a resin, and the resin is obtained by polymerizing a monomer mixture comprising styrene.

16. The apparatus according to claim 10, wherein an amount of the resin is from 1% by mass to 20% by mass in the toner.

17. The process cartridge according to claim 11, wherein primary particles of the fine inorganic particles have an average particle diameter of 100 nm or less.

18. The process cartridge according to claim 11, wherein an amount of the fine inorganic particles in the toner is from 0.1% by mass to 2.0% by mass.

19. The process cartridge according to claim 11, wherein an amount of the fine inorganic particles in the external additive is from 5% by mass to 30% by mass.

20. The process cartridge according to claim 11, wherein the protrusions comprise a resin, and the resin is obtained by polymerizing a monomer mixture comprising styrene.

* * * * *